US009557678B2

(12) United States Patent
Hoshino et al.

(10) Patent No.: US 9,557,678 B2
(45) Date of Patent: Jan. 31, 2017

(54) CHARGING DEVICE HAVING A HOLDING MEMBER THAT HOLDS A CHARGING MEMBER AND A CLEANING MEMBER, AND IMAGE FORMING APPARATUS USING THE CHARGING DEVICE

(71) Applicant: FUJI XEROX CO., LTD., Tokyo (JP)

(72) Inventors: Yuta Hoshino, Kanagawa (JP); Shiro Ohashi, Kanagawa (JP); Naoki Onishi, Kanagawa (JP); Tatsuya Soga, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/828,656

(22) Filed: Aug. 18, 2015

(65) Prior Publication Data

US 2016/0282744 A1 Sep. 29, 2016

(30) Foreign Application Priority Data

Mar. 23, 2015 (JP) ..... 2015-059526

(51) Int. Cl.
*G03G 15/02* (2006.01)

(52) U.S. Cl.
CPC ..... *G03G 15/0258* (2013.01); *G03G 15/0225* (2013.01)

(58) Field of Classification Search
CPC ..... G03G 15/0225; G03G 15/0258; G03G 15/0233; G03G 15/0208; G03G 15/0216; G03G 15/0283
USPC ..... 399/100
See application file for complete search history.

(56) References Cited

U.S. PATENT DOCUMENTS

2006/0115292 A1* 6/2006 Sampe ..... G03G 15/0225 399/100
2007/0177891 A1* 8/2007 Honobe ..... G03G 15/0225 399/100
2007/0183809 A1* 8/2007 Ishikawa ..... G03G 15/0225 399/100

(Continued)

FOREIGN PATENT DOCUMENTS

JP 2007-133065 A 5/2007
JP 2010-49290 A 3/2010
JP 2010-72623 A 4/2010

*Primary Examiner* — David Gray
*Assistant Examiner* — Laura Roth
(74) *Attorney, Agent, or Firm* — Sughrue Mion, PLLC

(57) ABSTRACT

A charging device includes a charging member that is opposed to and contacts a charged body, the charging member extending axially and rotating in response to rotation of the charged body, a cleaning member that extends axially along the charging member, and contacts a surface of the charging member to clean the charging member, a holding member that holds the charging member and the cleaning member in a manner allowing their displacement by a substantially constant amount while maintaining a distance between their axes, multiple bearing members provided to the holding member with their rotation being arrested, the bearing members individually supporting the shafts of the charging member and cleaning member in a manner allowing their rotation, the bearing members being displaced to follow a change in orientation of the shafts, and an urging member that urges the holding member to press the charging member onto the charged body.

17 Claims, 17 Drawing Sheets

(56) References Cited

U.S. PATENT DOCUMENTS

| | | | | |
|---|---|---|---|---|
| 2007/0189801 | A1* | 8/2007 | Miyaji | G03G 15/0225 399/100 |
| 2011/0013928 | A1* | 1/2011 | Kawai | G03G 15/0225 399/100 |
| 2011/0069988 | A1* | 3/2011 | Kurita | G03G 15/0225 399/100 |
| 2015/0098725 | A1* | 4/2015 | Kobayashi | G03G 15/0225 399/100 |

* cited by examiner

CHARGING DEVICE HAVING A HOLDING MEMBER THAT HOLDS A CHARGING MEMBER AND A CLEANING MEMBER, AND IMAGE FORMING APPARATUS USING THE CHARGING DEVICE

CROSS-REFERENCE TO RELATED APPLICATIONS

This application is based on and claims priority under 35 USC 119 from Japanese Patent Application No. 2015-059526 filed Mar. 23, 2015.

BACKGROUND

Technical Field

The present invention relates to a charging device and an image forming apparatus using the charging device.

SUMMARY

According to an aspect of the invention, there is provided a charging device including a charging member that is opposed to and contacts a charged body that is to be electrically charged, the charging member extending in an axial direction, the charging member rotating in response to rotation of the charged body, the charging member having a shaft, a cleaning member that extends in an axial direction along the charging member, the cleaning member contacting a surface of the charging member to clean the charging member, the cleaning member having a shaft, a holding member that holds the charging member and the cleaning member in a manner that allows the charging member and the cleaning member to be displaced by a substantially constant amount while maintaining a distance between their axes, plural bearing members provided to the holding member in a state in which rotation of the bearing members is arrested, the bearing members individually supporting the shaft of the charging member and the shaft of the cleaning member in a manner that allows rotation of the shafts, the bearing members being displaced so as to follow a change in orientation of the shafts, and an urging member that urges the holding member so as to press the charging member onto the charged body.

BRIEF DESCRIPTION OF THE DRAWINGS

Exemplary embodiment of the present invention will be described in detail based on the following figures, wherein.

DETAILED DESCRIPTION

General Overview of Exemplary Embodiment

Figure 1A:
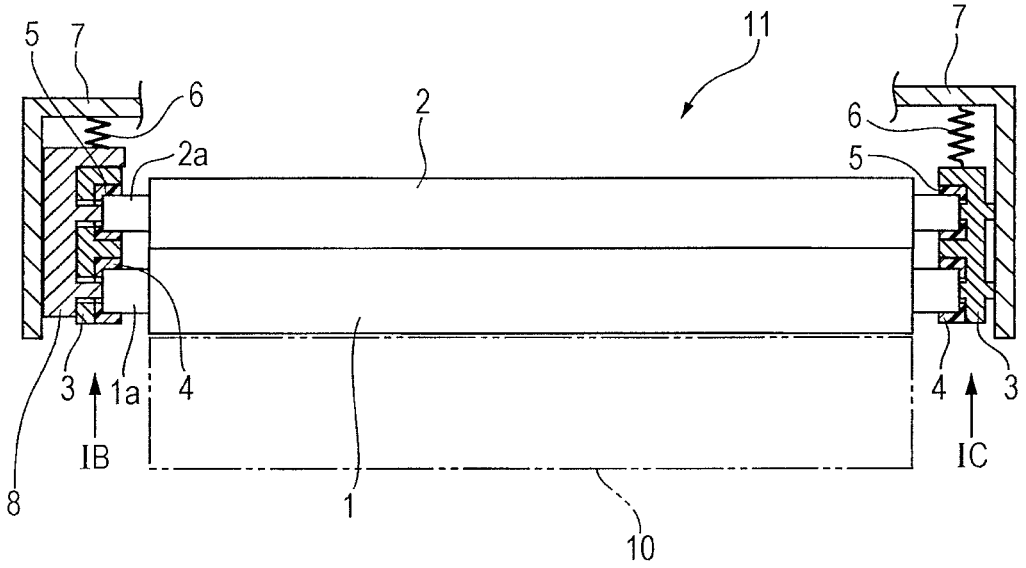
FIG. 1A illustrates a general overview of an image forming apparatus incorporating a charging device according to an exemplary embodiment of the present invention.

FIG. 1A illustrates a general overview of an image forming apparatus incorporating a charging device according to an exemplary embodiment of the invention.

In FIG. 1A, the image forming apparatus includes a body to be electrically charged (to be referred to as "charged body" hereinafter) 10, which is formed by an image carrier on which an electrostatic latent image can be formed, and a charging device 11 that charges the charged body 10.

This image carrier may be, for example, a photoconductor or a dielectric, and it does not matter whether the image carrier is in the form of a drum or a belt.

In this type of image forming apparatus, for example, an electrostatic latent image is formed on the charged body 10 that has been charged by the charging device 11, by an electrostatic latent-image forming device (not illustrated). A visible image developed by a developing device (not illustrated) is transferred to a recording medium via a transfer device (not illustrated) (including not only a transfer device of a direct transfer type but also a transfer device of an intermediate transfer type). An image on the recording medium which has not been fixed yet is fixed onto the recording medium by a fixing device (not illustrated).

Figure 1B:
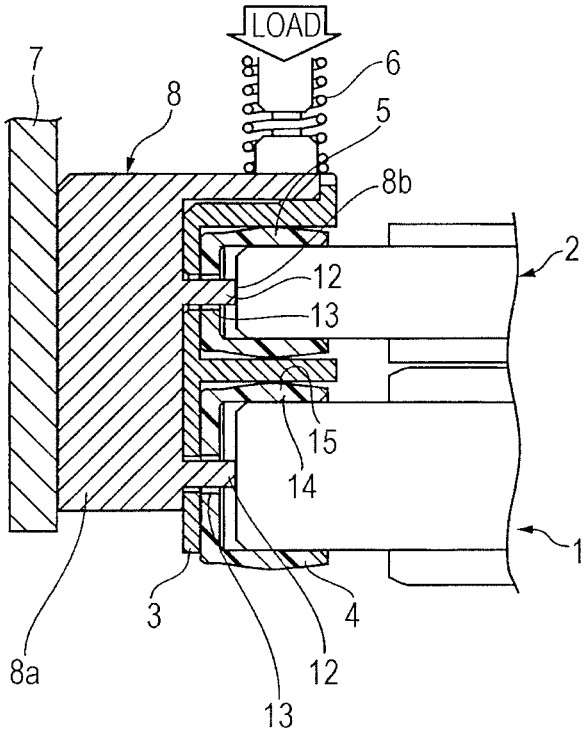
FIG. 1B illustrates a portion IB in FIG. 1A in detail.
Figure 1C:
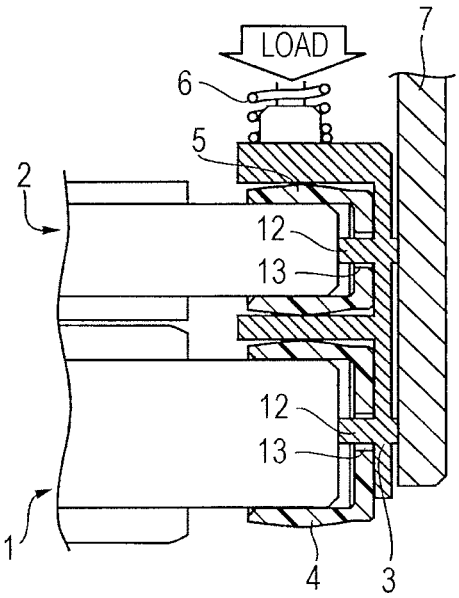
FIG. 1C illustrates a portion IC in FIG. 1A in detail.

In the present example, as illustrated in FIGS. 1A to 1C, the charging device 11 includes a charging member 1 that is opposed to and contacts the charged body 10 that is to be electrically charged, the charging member 1 extending in the axial direction, the charging member 1 rotating in response to rotation of the charged body 10, a cleaning member 2 that extends in the axial direction along the charging member 1, the cleaning member 2 contacting a surface of the charging member 1 to clean the charging member 1, a holding member 3 that holds the charging member 1 and the cleaning member 2 in a manner that allows the charging member 1 and the cleaning member 2 to be displaced by a constant amount while maintaining the distance between their axes, multiple bearing members 4 and 5 provided to the holding member 3 in a state in which rotation of the bearing members 4 and 5 is arrested, the bearing members 4 and 5 individually supporting respective shafts 1*a* and 2*a* of the charging member 1 and the cleaning member 2 in a manner that allows rotation of the shafts 1*a* and 2*a*, the bearing members 4 and 5 being displaced so as to follow a change in orientation of the shafts 1*a* and 2*a*, and an urging member 6 that urges the holding member 3 so as to press the charging member 1 onto the charged body 10.

Further, in the present example, as illustrated in FIGS. 1A and 1B, a feeding member 8 is provided on one end side in the axial direction of the charging member 1 and the cleaning member 2. The feeding member 8 has a feeding contact part that contacts the axial end portion of a fed member and feeds power to the fed member. The fed member is at least one (both in the present example) of the charging member 1 and cleaning member 2 which is to be fed with electric power.

Reference sign 7 denotes a charge housing in which the charging member 1, the cleaning member 2, the holding member 3, the bearing members 4 and 5, and the urging member 6 are accommodated.

The exemplary embodiment of the invention concerns the charging member 1 that rotates in response to rotation of the charged body 10, and the cleaning member 2 that rotates in response to rotation of the charging member 1. Accordingly, a holding mechanism is necessary which maintains the positional relationship between the axes of the charging member 1 and the cleaning member 2, and also follows their flexural deformation. The following situations may occur if such a holding structure is not provided. That is, the charging member 1 and the cleaning member 2 are not displaced by a constant amount to maintain the distance between their axes, and if the flexural deformations (shaft deflections) of the charging member 1 and the cleaning member 2 do not follow each other, the contact between the charging member 1 and the cleaning member 2 becomes unstable, with the result that the rotational force from the charged body 10 is not transmitted in a stable manner.

As the holding member 3, any holding member may be selected as appropriate as long as the holding member 3 holds the charging member 1 and the cleaning member 2 in a manner that allows displacement of the charging member 1 and the cleaning member 2 by a constant amount while maintaining the distance between their axes.

Further, the bearing members 4 and 5 are provided to the holding member 3 in a state in which their rotation is arrested. The bearing members 4 and 5 may support the respective shafts 1*a* and 2*a* of the charging member 1 and the cleaning member 2 in a manner that allows smooth movement (to be referred to as sliding hereinafter) of the shafts 1*a* and 2*a* individually. As for the material of the bearing members 4 and 5, it is desirable to use, for example, a resin material with a low frictional resistance and a high wear resistance, typical examples of which include polyacetal (POM) widely used for sliding members, as well as polyamide (PA) and PTFE.

The bearing members 4 and 5 are required to be displaced so as to follow changes in the orientation of the shafts 1*a* and 2*a* of the charging member 1 and the cleaning member 2, respectively. In this regard, for example, when the charging member 1 or the cleaning member 2 undergoes flexural deformation, the shaft 1*a* or 2*a* changes its orientation. If the bearing member 4 or 5 is unable to follow this change in orientation, the frictional resistance between the bearing member 4 or 5 and the shaft 1*a* or 2*a* of the charging member 1 or the cleaning member 2 increases, which may cause the rotation and support of the charging member 1 or the cleaning member 2 to become unstable.

Further, any suitable urging member may be selected as appropriate as the urging member 6 as long as the urging member 6 urges the charging member 1 so as to press the charging member 1 onto the charged body 10. Normally, an urging member of a type which urges the charging member 1 from its both axial ends is employed.

In the present example, each of the charging member 1 and the cleaning member 2 serves as a fed member. However, for example, in cases where it is unnecessary to feed power to the cleaning member 2, only the charging member 1 may be fed with power as a fed member by the feeding member 8.

The manner in which power is fed by the feeding member 8 may be selected as appropriate. In the present example, the feeding member 8 feeds power from the axial end portion of the fed member. Accordingly, it is unnecessary to feed power via the bearing members 4 and 5.

Next, various possible implementations of the charging device 11 according to the exemplary embodiment will be described below.

In one implementation, the bearing member 4 or 5 has a receiving part that supports the shaft 1*a* or 2*a* of the charging member 1 or the cleaning member 2 in a manner that allows rotation of the shaft 1*a* or 2*a*. The receiving part is formed by a recess having a circular cross-section. A mating detent part 13 is provided at the bottom of the receiving part. The mating detent part 13 is engaged with a detent member 12 disposed on the holding member 3 side to thereby arrest rotation.

The bearing member 4 or 5 has a receiving part capable of supporting the charging member 1 or the cleaning member 2. At the time of mounting the bearing member 4 or 5 to the holding member 3, the detent member 12 on the holding member 3 side and the mating detent part 13 engage each other so that the bearing member 4 or 5 is mounted to the holding member 3 in a state in which its rotation is arrested.

In the present example, it is unnecessary to provide play between the inside diameter of the receiving part of the bearing member 4 or 5 and the outside diameter of the shaft 1*a* or 2*a* of the charging member 1 or the cleaning member 2. Accordingly, it is possible to make the receiving part and the shaft 1*a* or 2*a* of the charging member 1 or the cleaning member 2 fit each other with good accuracy.

For example, the mating detent part 13 may be in the form of a hole or groove that fits onto the detent member 12 that is in the form of a protrusion.

In the present example, in the bearing structure on the feeding side, the feeding contact part of the feeding member 8 doubles as the detent member 12 as illustrated in FIG. 1B. Each of the holding member 3 and the bearing members 4 and 5 is provided with a hole that serves as the mating detent part 13, and the detent member 12 is fitted into the mating detent part 13.

In the present example, in the bearing structure on the non-feeding side, a part of the holding member 3 is formed as a protrusion to double as the detent member 12 as illustrated in FIG. 1C. Each of the bearing members 4 and 5 is provided with a hole that serves as the mating detent part 13, and the detent member 12 is fitted into the mating detent part 13.

Further, in one implementation, the bearing member 4 or 5 has a receiving part 14 that supports the shaft 1*a* or 2*a* of the charging member 1 or the cleaning member 2 in a manner that allows rotation of the shaft 1*a* or 2*a*. The receiving part 14 is formed by a recess having a circular cross-section. An overhanging part 15, which hangs over outward, is formed annularly in a part of the outer peripheral wall of the receiving part 14. The bearing member 4 or 5 changes its orientation about the contact part between the overhanging part 15 and the holding member 3 as an axis.

In the present example, the overhanging part 15 may be formed as a barrel-shaped overhanging part by continuously or partially changing the thickness of the outer peripheral wall of the receiving part 14, or may be formed as a partially stepped overhanging part. That is, as the cross-sectional shape of the overhanging part 15, any suitable cross-sectional shape may be selected as appropriate. When the charging member 1 or the cleaning member 2 undergoes flexural deformation and its shaft changes in orientation, the bearing member 4 or 5 changes its orientation within the holding member 3 about the overhanging part 15, which is formed in the outer peripheral wall of the receiving part 14, as an axis. Consequently, the bearing member 4 or 5 moves following the change in the orientation of the charging member 1 or the cleaning member 2.

Furthermore, in one implementation, a non-conductive POM with a low coefficient of friction and a high wear resistance is used as the bearing members 4 and 5.

In one implementation, the holding member 3 has a recess into which each of the bearing members 4 and 5 fits, and the detent member 12 is disposed at the bottom of the recess. The mating detent part 13, which is formed in each of the bearing members 4 and 5 in advance, is engaged with the detent member 12 upon fitting each of the bearing members 4 and 5 into the recess. In this implementation, the holding member 3 may have a recess into which the bearing member 4 or 5 fits, and the detent member 12 that arrests rotation of the bearing member 4 or 5 may be disposed in the recess. While the detent member 12 may be directly provided in the holding member 3, the detent member 12 may be disposed in a component separate from the holding member 3 (for example, in a part of the feeding member 8 illustrated in FIG. 1B).

Further, in the present example, an axially pressing member (not illustrated) that presses the charging member 1 and the cleaning member 2 in the axial direction may be provided between the charge housing 7 and the holding member 3.

In one implementation, the charge housing 7 has a stopping wall provided on the back side of the holding member 3 opposite to the side of the holding member 3 which holds the bearing members 4 and 5. The stopping wall opens toward the holding member 3 and has a substantially U-shaped cross-section. The holding member 3 is brought into contact with the stopping wall. In this implementation, the charge housing 7 has a stopping wall with a high rigidity that has a substantially U-shaped cross-section, and the axial load of the charging member 1 and the cleaning member 2 is borne by this stopping wall.

Further, in one implementation, as illustrated in FIG. 1B, the feeding member 8 has a feeding conductive member 8*a* disposed on the back side of the holding member 3 opposite to the side of the holding member 3 which holds the bearing members 4 and 5, and the feeding conductive member 8*a* has a feeding projection 8*b* that projects through a through-hole (which doubles as a hole serving as the mating detent part 13 in the present example) formed in each of the holding member 3 and the bearing members 4 and 5 to contact an end face of the fed member.

Further, in one implementation, the feeding member 8 doubles as the detent member 12 as illustrated in FIG. 1B. Alternatively, the feeding member 8 has a projecting part (not illustrated) provided in a part of the feeding member 8. The projecting part projects so as to contact the axial end portion of the fed member. The projecting part permits a change in the orientation of the fed member (the charging member 1 or the cleaning member 2). In this implementation, a projecting part is integrally provided in a part of the feeding member 8. This projecting part and the axial end portion of the fed member are brought into contact with each other so that the axial end portion of the fed member changes its orientation while in contact with the projecting part.

Furthermore, in one implementation, a part of the feeding member 8 located closest to the charged body 10 is disposed farther away from the charged body 10 than the bearing member 4 for the charging member 1, which is an electrically non-conductive bearing member.

Exemplary Embodiment 1

Hereinafter, the exemplary embodiment of the invention will be described in more detail with reference to the attached figures.

—General Configuration of Image Forming Apparatus—

Figure 2:
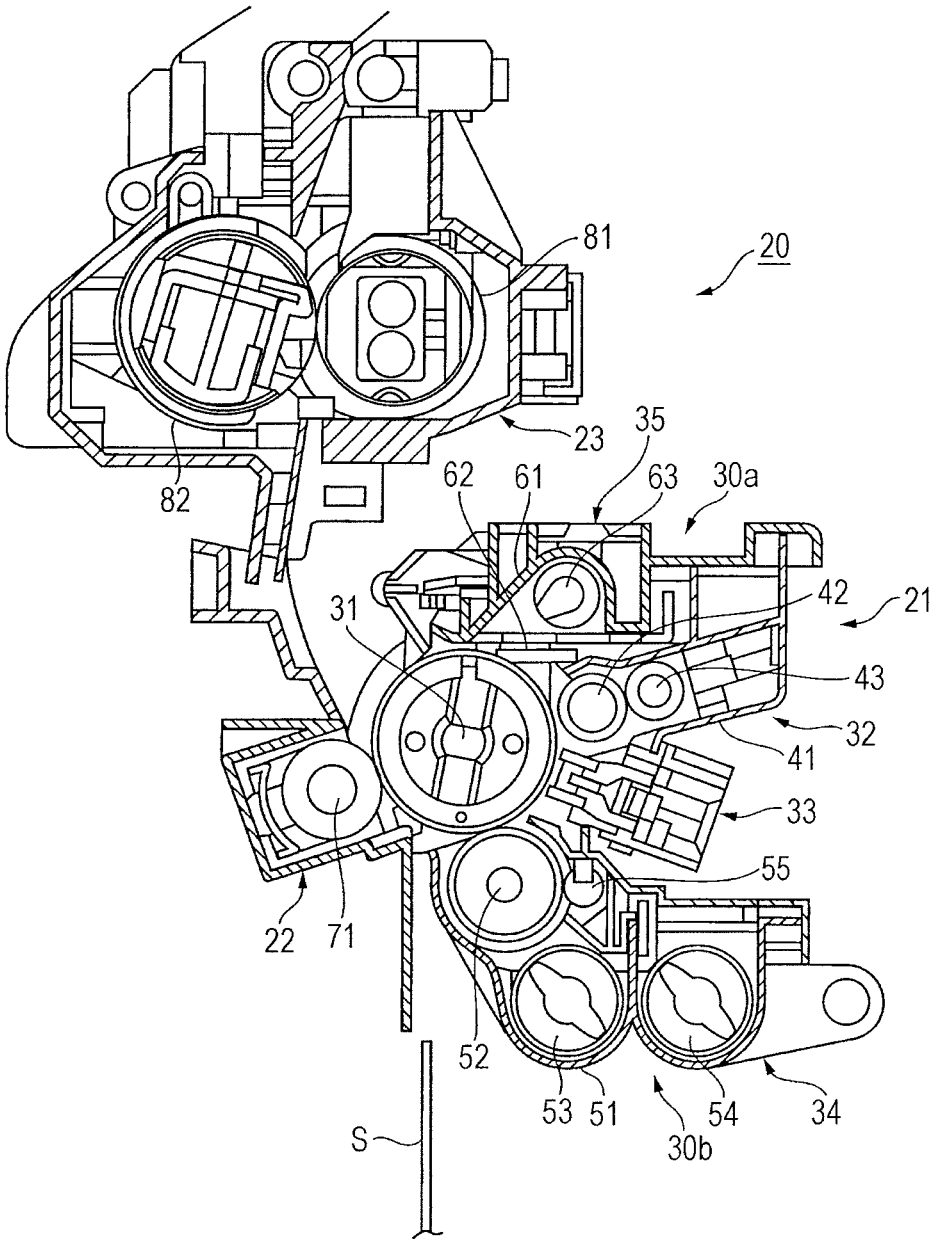
FIG. 2 illustrates a major portion of an image forming apparatus according to Exemplary Embodiment 1.
Figure 3:
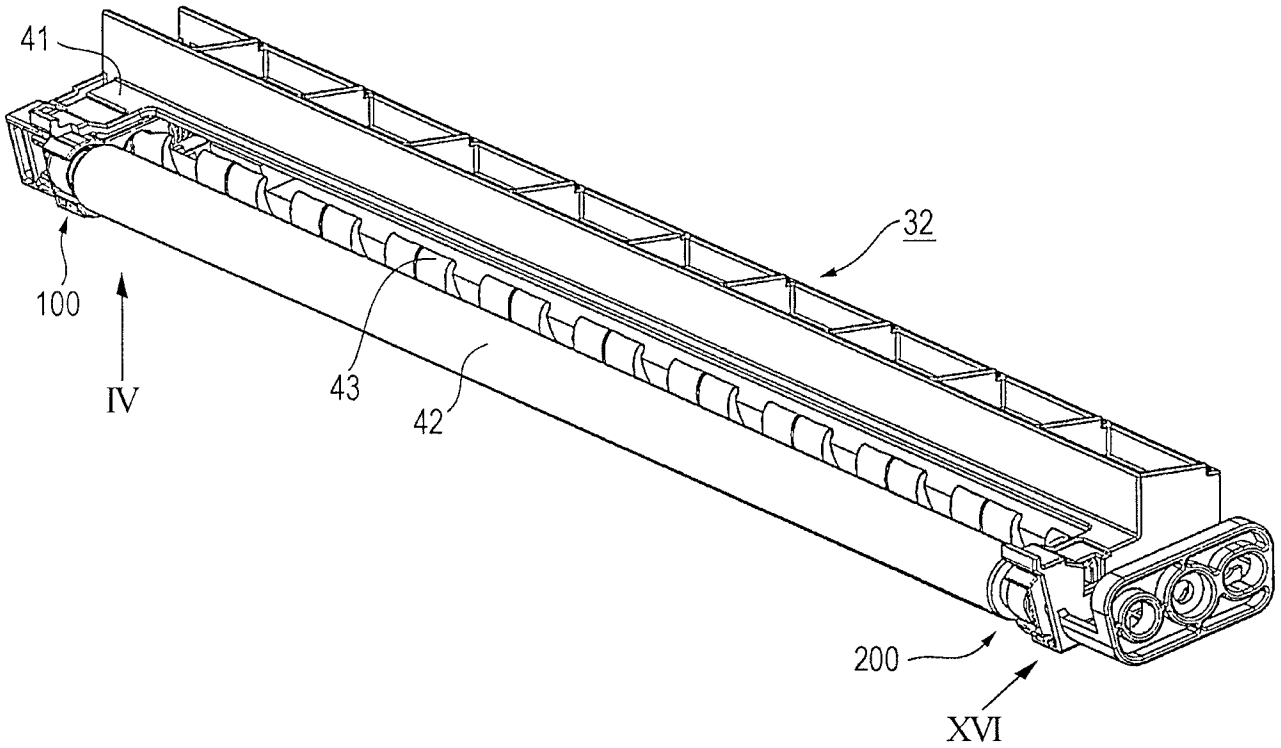
FIG. 3 is a perspective view illustrating a general configuration of a charging device according to Exemplary Embodiment 1.

FIG. 2 illustrates a major portion of an image forming apparatus according to Exemplary Embodiment 1.

In FIG. 2, an image forming apparatus 20 has a process cartridge 21 that adopts, for example, an electrophotographic system and forms a single-color (black in the present example) image, a transfer device 22 that transfers the image formed by the process cartridge 21 to a recording medium S, and a fixing device 23 that fixes the image transferred to the recording medium S by the transfer device 22 onto the recording medium S. The recording medium S supplied from a recording medium supply device (not illustrated) is passed through a transfer part between the process cartridge 21 and the transfer device 22 via a predetermined transport path. Then, the recording medium S on which an image has been formed is output to a recording medium output receiver (not illustrated) via the fixing device 23.

—Process Cartridge—

In Exemplary Embodiment 1, the process cartridge 21 is detachably mounted to a cartridge receiving part (not illustrated) of the body of the image forming apparatus.

In the present example, the process cartridge 21 includes a photoconductor cartridge 30*a* and a developing cartridge 30*b*. In the photoconductor cartridge 30*a*, a photoconductor 31, a charging device 32 that charges the photoconductor 31, and a cleaning device 35 that cleans the photoconductor 31 are incorporated into a common housing. The developing cartridge 30*b* is held in a predetermined position with respect to the photoconductor cartridge 30*a*. A developing device 34 for developing an electrostatic latent image on the photoconductor 31 is incorporated into the developing cartridge 30*b*.

Further, the cartridge receiving part of the body of the image forming apparatus is provided with an LED array 33, which is an example of an exposure device for writing an electrostatic latent image onto the photoconductor 31. The LED array 33 is temporarily retracted from a set position in accordance with an attaching or detaching operation of the process cartridge 21.

In the present example, as illustrated in FIG. 2, the charging device 32 has a charge housing 41 that is open in a part opposed to the photoconductor 31. A charging roller 42 and a cleaning roller 43 are disposed inside the charge housing 41. The charging roller 42 is a charging member that contacts the surface of the photoconductor 31. The cleaning roller 43 is used to clean the charging roller 42. Details of the charging device 32 will be given later.

The developing device 34 has a developing container 51 which is open in a part opposed to the photoconductor 31 and in which, for example, a developer including a toner and a carrier is received. A developing roller 52, which is capable of carrying developer, is disposed in a part of the developing device 34 facing the opening of the developing container 51. Agitating and transport members 53 and 54, which are capable of agitating and transporting developer in a circulating manner, are disposed on the back side of the developing roller 52 of the developing container 51. Further, a layer thickness regulating member 55, which regulates the layer thickness of developer that can be carried on the developing roller 52, is provided in a part of the developing device 34 opposed to the developing roller 52.

Further, the cleaning device 35 has a cleaning container 61 that is open in a part opposed to the photoconductor 31. A scraping member 62 having a plate-like shape, which comes into elastic contact with the photoconductor 31, is provided in an edge portion of the opening along the longitudinal direction of the cleaning container 61. Further, a transport member 63 is disposed inside the cleaning container 61. The transport member 63 transports residues such as toner scraped off by the scraping member 62 along the longitudinal direction of the cleaning container 61 for discharge to the outside.

In the present example, the transfer device 22 has a transfer roller 71 opposed to the photoconductor 31. The transfer device 22 applies a transfer bias to the transfer roller 71 to form a transfer electric field between the photoconductor 31 and the transfer roller 71. The transfer device 22 causes an image on the photoconductor 31 to move to the recording medium S by this transfer electric field.

Further, the fixing device 23 has a heat fixing roller 81 that has a heater inside the heat fixing roller 81, and a pressure fixing roller 82 that rolls while in contact with the heat fixing roller 81 with a predetermined pressure. The fixing device 23 fixes an image on the recording medium S onto the recording medium S by application of heat and pressure in the fixing region between the heat fixing roller 81 and the pressure fixing roller 82.

—Charging Roller and Cleaning Roller—

Figure 4:
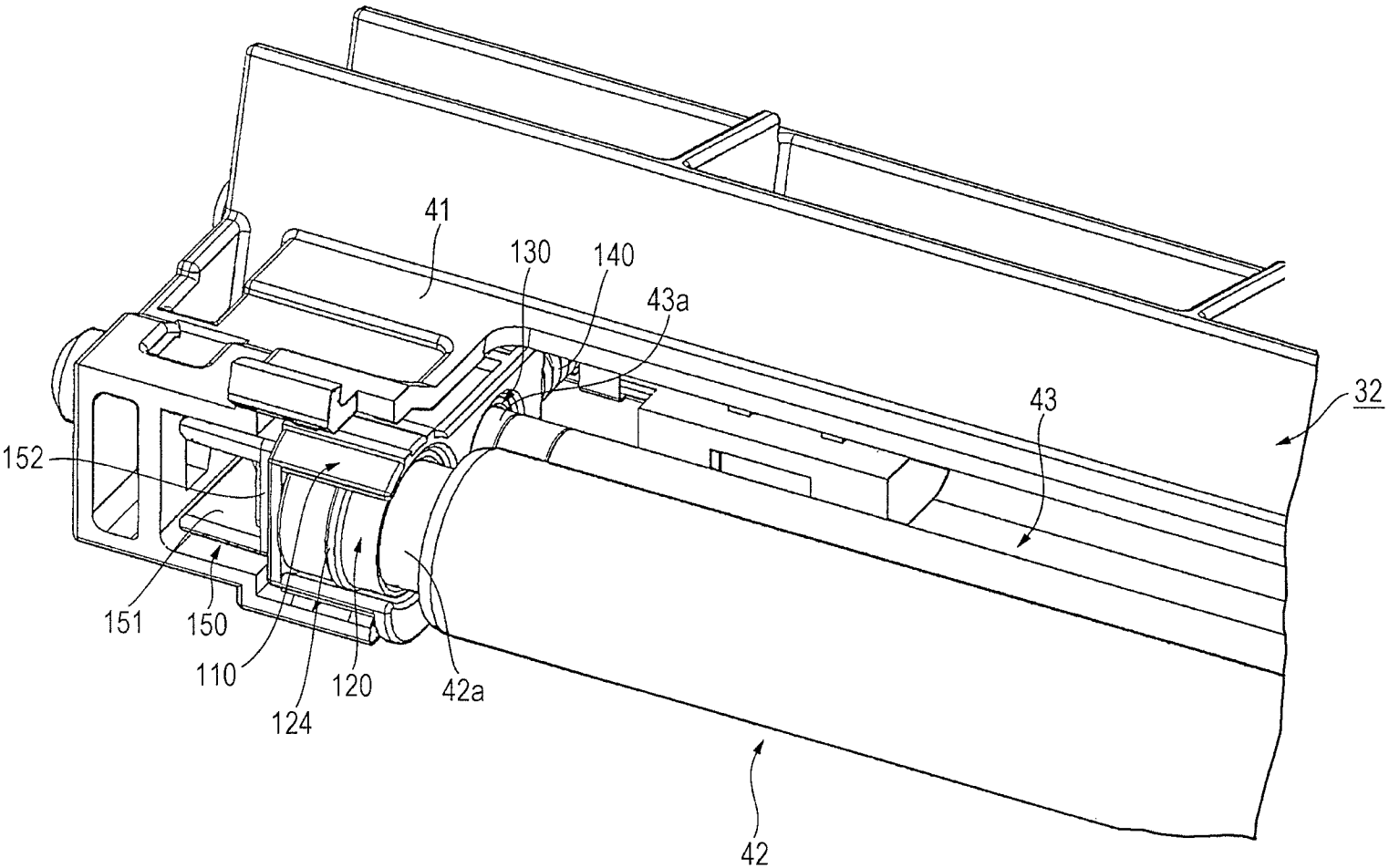
FIG. 4 is a perspective view illustrating a portion IV in FIG. 3 in detail.
Figure 5:
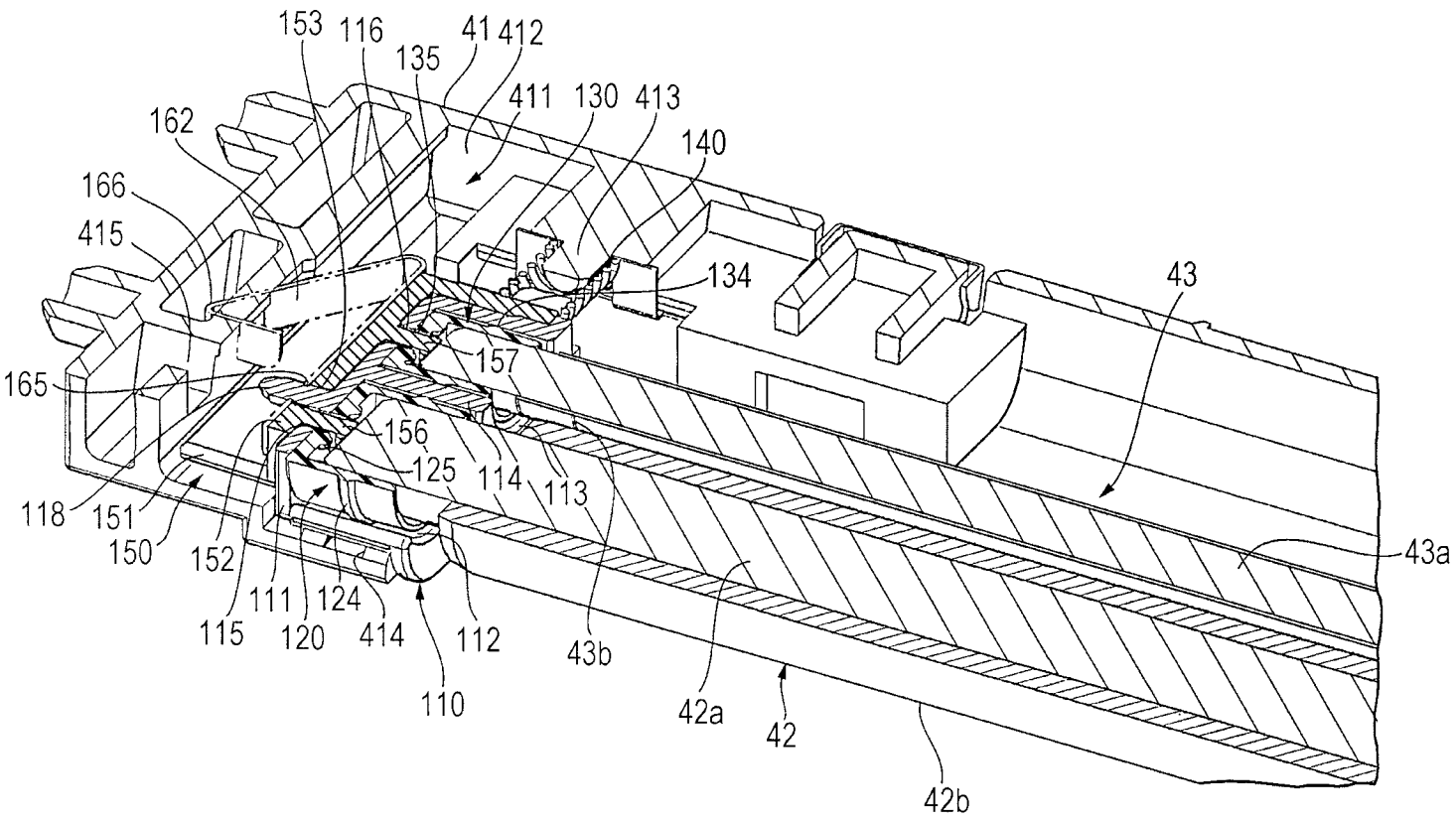
FIG. 5 is a cross-sectional view illustrating a bearing structure on the feeding side of a charging device according to Exemplary Embodiment 1.
Figure 6:
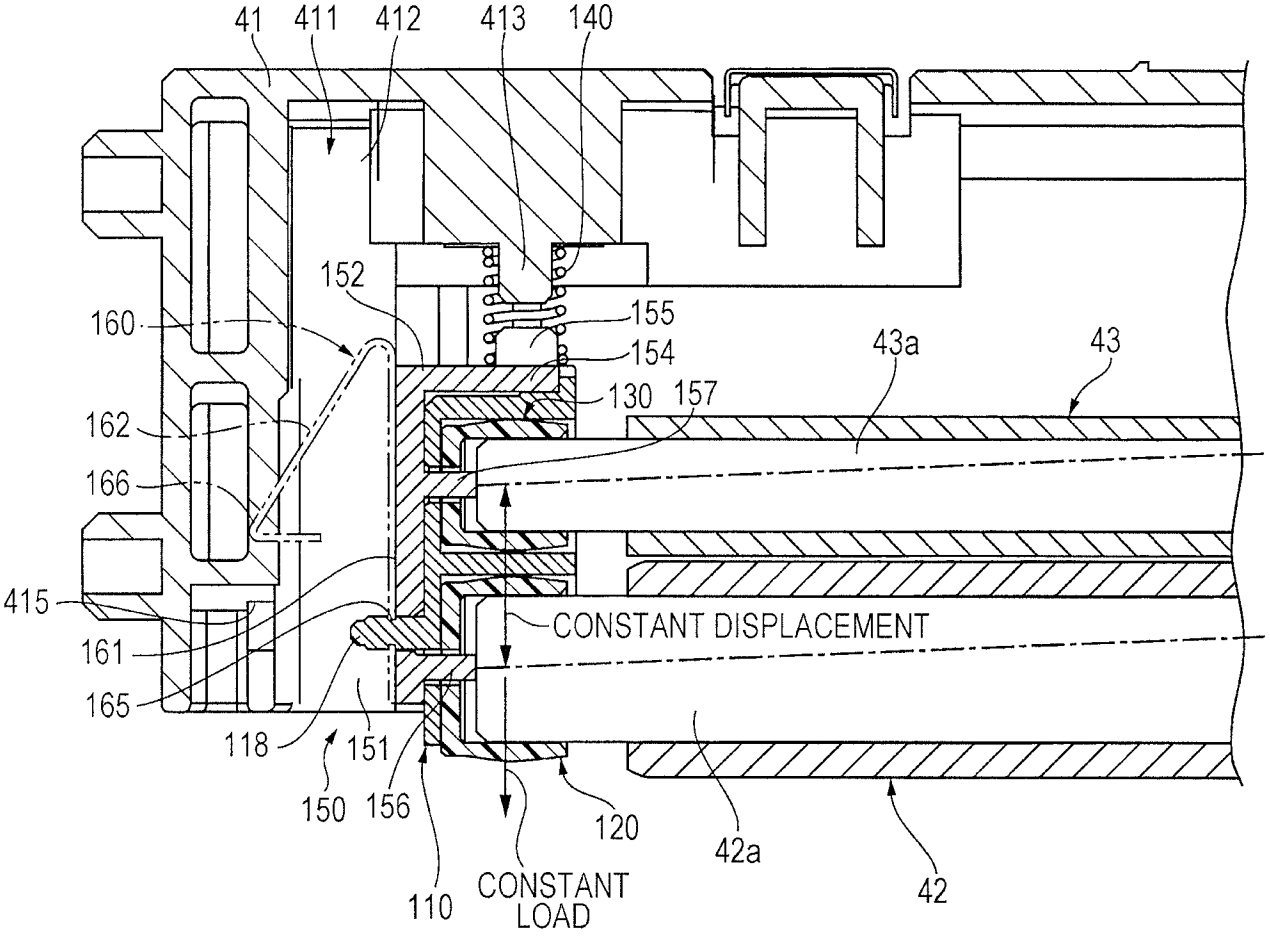
FIG. 6 is a plan view of FIG. 5.

In Exemplary embodiment 1, as illustrated in FIGS. 4 to 6, the charging roller 42 has a shaft 42*a* made of metal and having electrical conductivity. A charging layer 42*b* is formed in an area of the shaft 42*a* excluding the support part at each end of the shaft 42*a*.

The cleaning roller 43 has a shaft 43*a* made of metal and having electrical conductivity. For example, a sponge material as a cleaning material is wound around the shaft 43*a* in a spiral fashion to form a sponge layer 43*b*. The material of this type of the sponge layer 43*b* is selected from either a resin foam such as polyurethane, polyethylene, polyamide, or polypropylene, or rubber.

In the present example, the cleaning roller 43 is pressed against the charging roller 42 with a predetermined load, causing the sponge layer 43*b* to be elastically deformed along the peripheral surface of the charging roller 42 to form a contact region. The photoconductor 31 is rotationally driven by a motor (not illustrated). The charging roller 42 rotates in response to the rotation of the photoconductor 31 (such rotation will be hereinafter also referred to as responsive rotation). Further, the cleaning roller 43 rotates in response to the rotation of the charging roller 42.

As the cleaning roller 43 rotates in response to the rotation of the charging roller 42 in this way, foreign substances such as toner or external additives adhering to the surface of the charging roller 42 are cleaned away by the cleaning roller 43. It is assumed that the foreign substances are taken into the cells of the resin foam of the cleaning roller 43, and once the foreign substances collected in the cells aggregate into a suitable size, the foreign substances are returned from the cleaning roller 43 to the photoconductor 31 via the charging roller 42, and recovered by the cleaning device 35 of the photoconductor 31.

—Bearing Mechanism of Charging Device—

In Exemplary Embodiment 1, as illustrated in FIG. 4 to FIG. 6, the respective shafts 42*a* and 43*a* of the charging roller 42 and the cleaning roller 43 are rotatably supported by use of bearing mechanisms 100 and 200.

In the present example, a feeding mechanism 150 is incorporated into the bearing mechanism 100 located on one axial end side of the charging roller 42 and the cleaning roller 43. A charging bias and a cleaning bias are applied to the charging roller 42 and the cleaning roller 43, respectively. The feeding mechanism 150 is not incorporated in the bearing mechanism 200 located on the other end side.

—Bearing Mechanism on Feeding Side—

First, the bearing mechanism 100 on the feeding side will be described with reference to FIGS. 4 to 14.

In Exemplary Embodiment 1, the bearing mechanism 100 has the following structure. A mounting part 411 for incorporating the bearing mechanism 100 is provided in a predetermined part of the charge housing 41. A positioning holder 110 is placed in the mounting part 411. The positioning holder 110 holds the respective shafts 42*a* and 43*a* of the charging roller 42 and the cleaning roller 43 so that the distance between the axes of the charging roller 42 and the cleaning roller 43 is kept constant. Bearing members 120 and 130 are incorporated into the positioning holder 110. The bearing members 120 and 130 support the shafts 42*a* and 43*a*, respectively, in a manner that allows their rotation. Further, an urging spring 140 formed by, for example, a coil spring is provided to urge the positioning holder 110 toward the photoconductor 31. Furthermore, the feeding mechanism 150 is placed on the side of the positioning holder 110 opposite to the side where the bearing members 120 and 130 are incorporated.

Each of the elements mentioned above is described below in detail.

<Mounting Part of Charge Housing>

Figure 9:
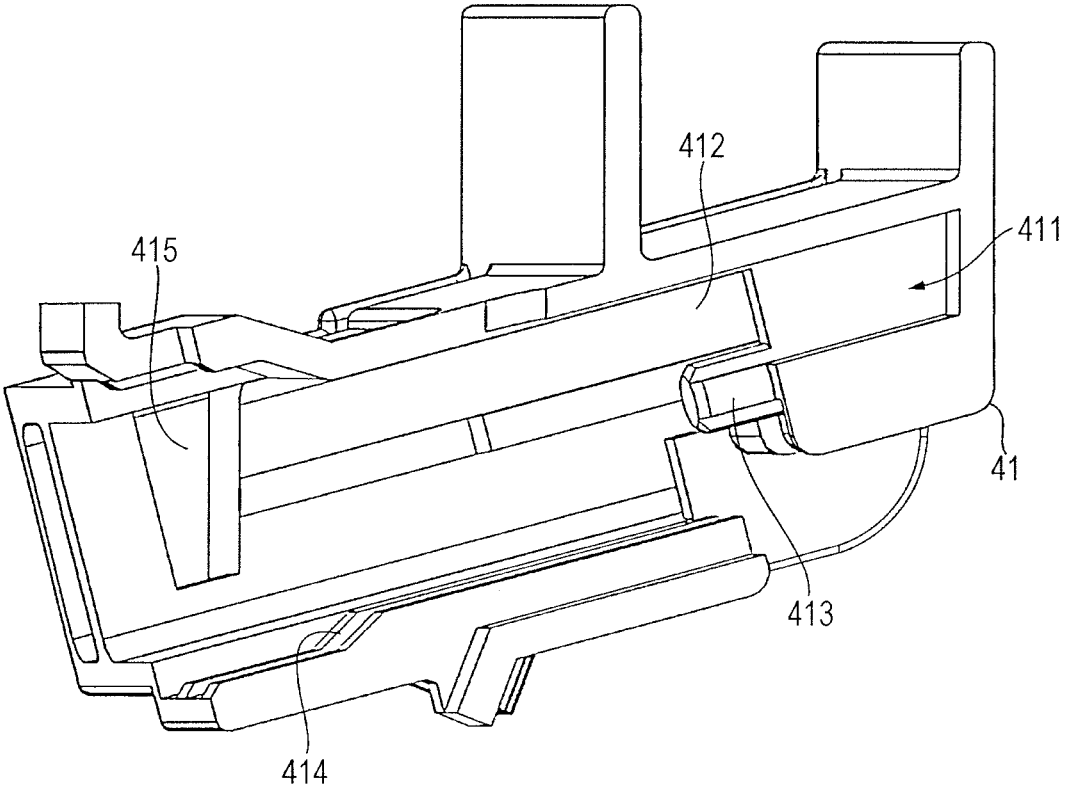
FIG. 9 illustrates a charge housing into which a bearing structure on the feeding side of a charging device is incorporated, according to Exemplary Embodiment 1.
Figure 10:
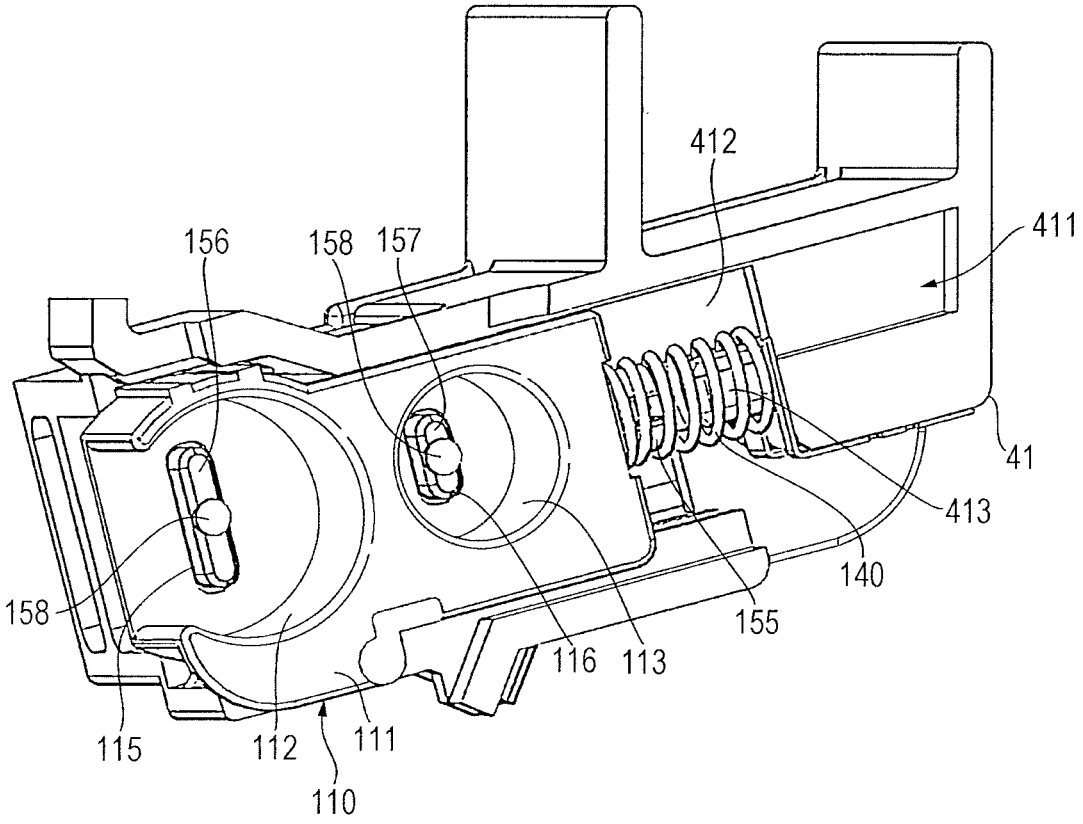
FIG. 10 illustrates a state in which a holder for a bearing structure is incorporated into the charge housing illustrated in FIG. 9, together with a feeding mechanism.

As illustrated in, for example, FIGS. 5, 6, and 9, the mounting part 411 of the charge housing 41 has an accommodating chamber 412 in which the positioning holder 110 and the feeding mechanism 150 can be disposed. A part of the accommodating chamber 412 is provided with a positioning boss 413. The positioning boss 413 holds the urging spring 140 in a manner that allows positioning of the urging spring 140. Further, the accommodating chamber 412 of the charge housing 41 is provided with a guide rail 414 that extends from the photoconductor 31 side toward the positioning boss 413.

<Positioning Holder>

As illustrated in FIGS. 4 to 8 and FIG. 10, the positioning holder 110 has a holder body 111 made of, for example, commonly used resin (for example, POM). The holder body 111 is provided with recesses 112 and 113 into which the bearing members 120 and 130 are fitted, respectively.

In the present example, the recess 112 for the charging roller 42 is cut away on the photoconductor 31 side. The recess 113 for the cleaning roller 43 has a substantially circular shape in cross section. A partition wall 114 is provided between the recesses 112 and 113. The partition wall 114 has a dimension substantially corresponding to the sum of the thickness of the charging layer 42*b* of the charging roller 42 and the thickness of the sponge layer 43*b* of the cleaning roller 43.

Further, elongated holes 115 and 116 are formed at the bottom walls of the recesses 112 and 113 of the positioning holder 110, respectively. The depth dimensions of the recesses 112 and 113 substantially correspond to the axial lengths of the bearing members 120 and 130, respectively.

Furthermore, in Exemplary Embodiment 1, the holder body 111 is provided with a guide shoe (not illustrated) that slides along the guide rail 414 of the charge housing 41. At the time of mounting the positioning holder 110 to the mounting part 411, the positioning holder 110 is mounted to the mounting part 411 while being linearly guided along the guide rail 414.

A positioning pin 118 for positioning with respect to the feeding mechanism 150 described later is provided on the back side of the holder body 111 of the positioning holder 110 which is located opposite to the recesses 112 and 113.

<Bearing Member>

In the present example, as illustrated in FIGS. 4 to 8 and FIGS. 11A and 11B, the bearing member 120 or 130 is integrally molded from a resin material with good sliding property and high wear resistance, for example, a non-conductive POM. The bearing member 120 or 130 has a recess 121 or 131 with a circular cross-section into which the shaft 42*a* or 43*a* of the charging roller 42 or the cleaning roller 43 fits. The bottom wall of the recess 121 or 131 is provided with an elongated hole 125 or 135 corresponding to the elongated hole 115 or 116 of the positioning holder 110. Further, in the present example, the inner surface of the bottom wall of the recess 121 or 131 is provided with two protrusions 122 or 132 having a substantially semi-spherical shape, with the elongated hole 125 or 135 therebetween. When the shaft 42*a* or 43*a* of the charging roller 42 or the cleaning roller 43 changes its orientation, the protrusion 122 or 132 comes into contact with the axial end portion of the shaft 42*a* or 43*a* in a state in which the axial end portion is tilted. As such, the protrusion 122 or 132 is provided with the intention of minimizing the sliding resistance between the axial end portion of the charging roller 42 or the cleaning roller 43 and the inner surface of the bottom wall of the recess 121 or 131 of the bearing member 120 or 130.

In particular, in Exemplary Embodiment 1, a flange 124 or 134, which is an overhanging part that partially hangs over outward, is formed annularly near substantially the central part of the outer surface of a peripheral wall 123 or 133 of the recess 121 or 131 of the bearing member 120 or 130. In the present example, as illustrated in FIG. 11C, the flange 124 or 134 is formed in the shape of a rectangle (a trapezoid in the present example) in cross section. The inside diameter of the recess 112 or 113 of the positioning holder 110 is set substantially equal to the outside diameter of the flange 124 or 134 of the bearing member 120 or 130.

In the present example, as illustrated in FIG. 11C, the flange 124 or 134 partially hangs over in comparison to other portions of the peripheral wall 123 or 133. However, the shape of the flange 124 is not limited to this. For example, the flange 124 or 134 may have an arcuate cross-sectional shape. Alternatively, as illustrated in FIG. 11D, the flange 124 or 134 may be formed as a barrel-shaped overhanging part 124' or 134' by continuously changing the thickness of the entire peripheral wall 123 or 133, with the amount of overhang becoming maximum near the center of the peripheral wall 123 or 133.

<Urging Spring>

As illustrated in FIGS. 4 to 8 and FIG. 10, once the urging spring 140 is positioned by the positioning boss 413, the urging spring 140 urges the positioning holder 110 toward the photoconductor 31.

<Feeding Mechanism>

In the present example, as illustrated in FIGS. 4 to 8, the feeding mechanism 150 has a feeding block 151 placed between the mounting part 411 of the charge housing 41 and the positioning holder 110. The feeding mechanism 150 is U-shaped in cross section and has electrical conductivity. The feeding block 151 has a vertical wall 152 disposed between the feeding block 151 and the positioning holder 110 so as to be in contact with the positioning holder 110. A positioning hole 153 is provided in a part of the vertical wall 152. A bent strip 154 is provided in a part on the urging spring 140 side of the feeding block 151. The bent strip 154 is bent along an end portion on the urging spring 140 side of the positioning holder 110. The positioning pin 118, which is formed in the positioning holder 110 in advance, is inserted into the positioning hole 153. The bent strip 154 of the feeding block 151 is disposed in contact with the end portion on the urging spring 140 side of the positioning holder 110. In this way, the feeding block 151 and the positioning holder 110 are attached onto each other in a predetermined positional relationship. A catching boss 155 is provided near the distal end of the bent strip 154 of the feeding block 151, in an area opposed to the positioning boss 413 provided in the mounting part 411. The urging spring 140 positioned by the positioning boss 413 is caught on the catching boss 155 of the feeding block 151, thus urging the positioning holder 110 via the bent strip 154.

Further, the vertical wall 152 of the feeding block 151 is provided with feeding projections 156 and 157 that project in a direction toward the positioning holder 110. Each of the feeding projections 156 and 157 is formed in a substantially rectangular shape in cross section that corresponds to the elongated hole 115 or 116 of the positioning holder 110 and the elongated hole 125 or 126 of the bearing member 120 or 130. The dimension of projection h of the feeding projection 156 or 157 satisfies the following relationship: $h > d1 + d2 + d3$, where d1 denotes the thickness of the bottom wall of the recess 112 or 113 of the positioning holder 110, d2 denotes the thickness of the bottom wall of the recess 121 or 131 of the bearing member 120 or 130, and d3 denotes the height dimension of the protrusion 122 or 132 of the bearing member 120 or 130.

Accordingly, as the feeding projection 156 or 157 fits into the elongated hole 115 or 116 of the positioning holder 110 and the elongated hole 125 or 135 of the bearing member 120 or 130, the bearing member 120 or 130 is incorporated into the positioning holder 110 with its rotation being arrested.

Further, in the present example, the feeding projection 156 or 157 is disposed in contact with the axial end portion of the charging roller 42 or the axial end portion of the cleaning roller 43 that is supported by the bearing member 120 or 130.

In particular, in Exemplary Embodiment 1, a minute projection 158 having a substantially circular cross-section is provided at substantially the center of each of the feeding projections 156 and 157. The minute projection 158 serves as a contact part with the axial end portion of the charging roller 42 or the axial end portion of the cleaning roller 43.

Figure 7:
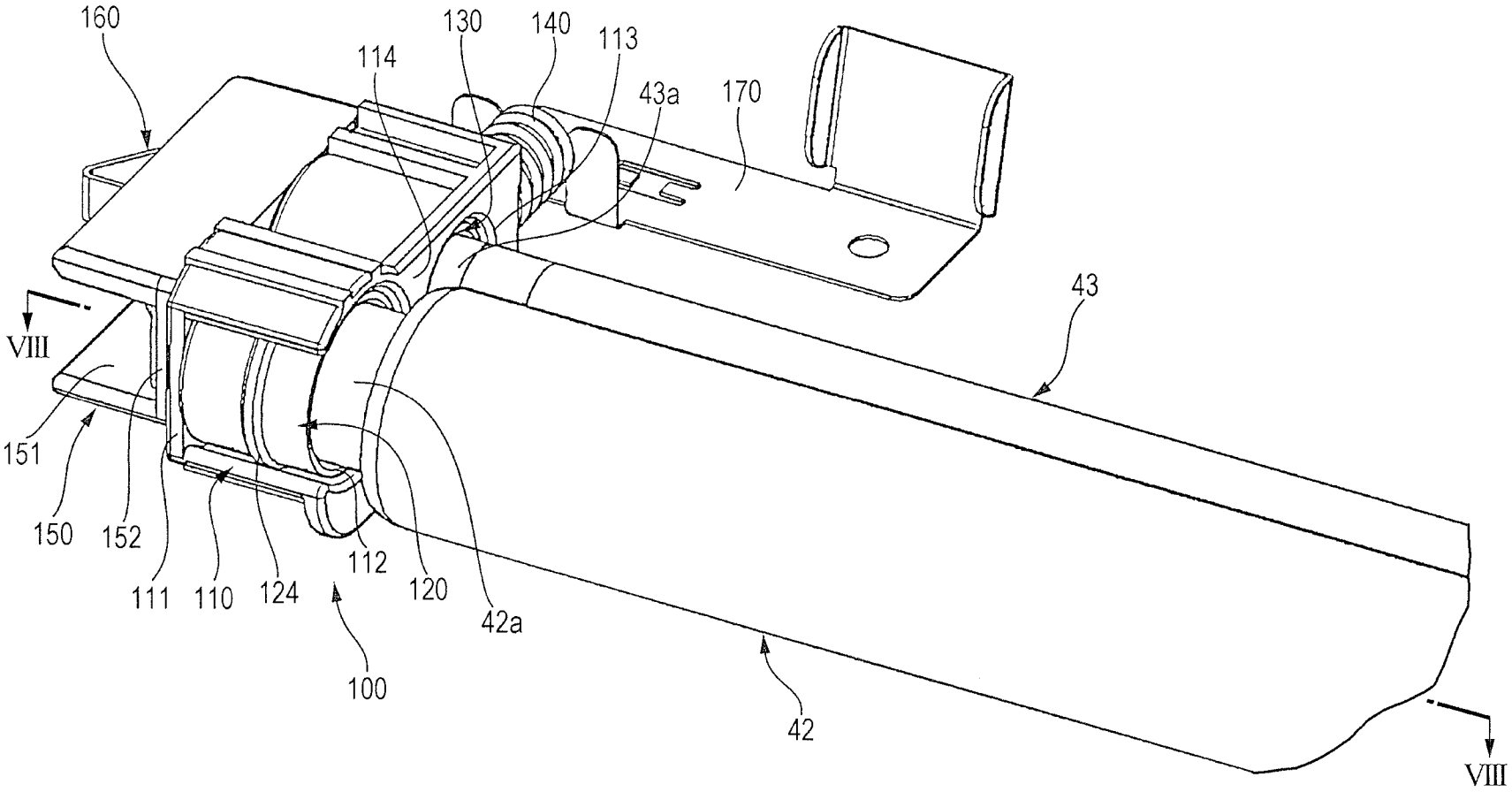
FIG. 7 is a perspective view illustrating a charging device, with a charge housing removed from FIG. 4.
Figure 8:
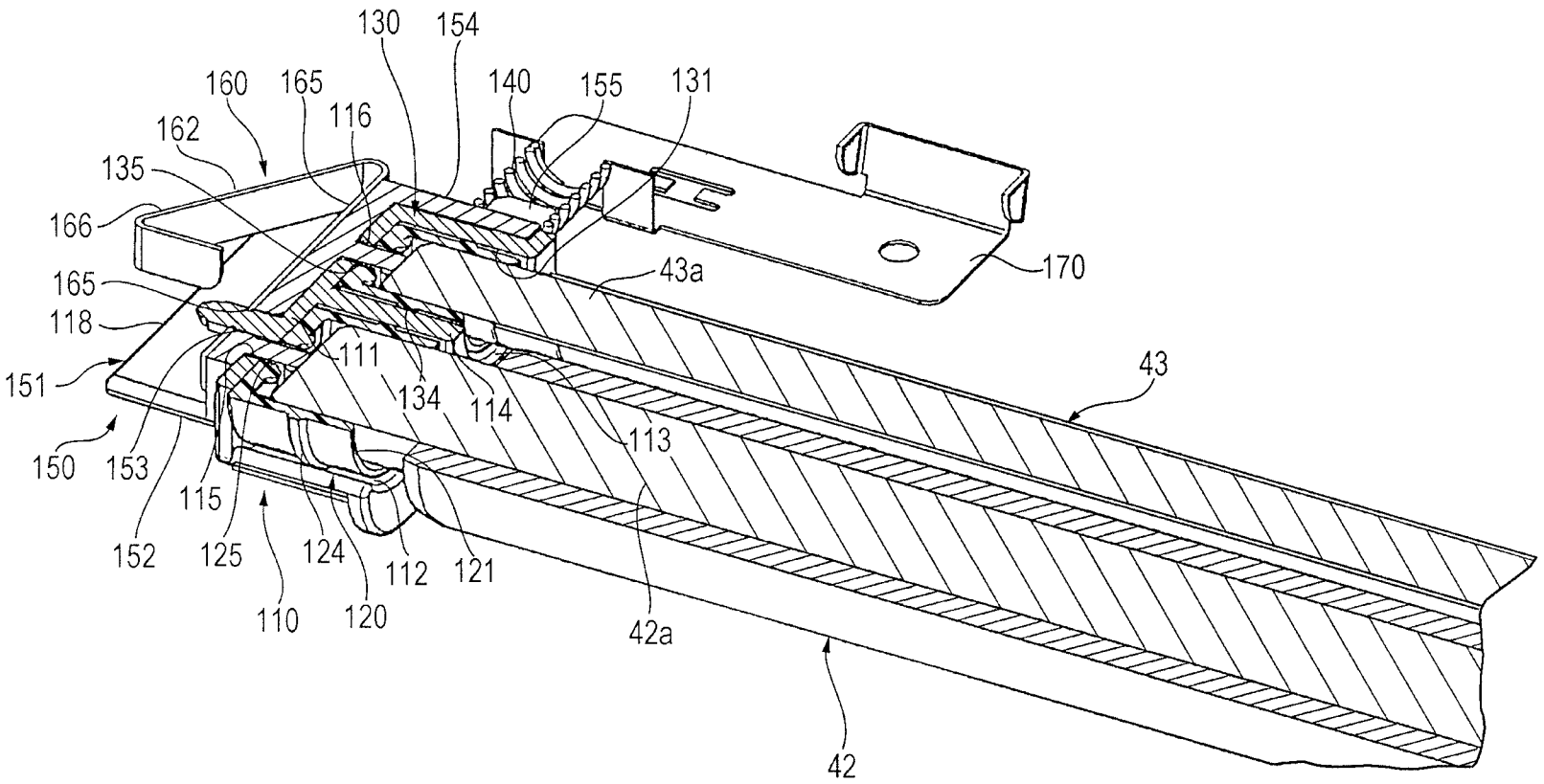
FIG. 8 is a cross-sectional view taken along a line VIII-VIII in FIG. 7.

In FIGS. 7 and 8, reference sign 170 denotes a connection terminal used for power feeding. The feeding mechanism 150 feeds power fed from the connection terminal 170 to the charging roller 42 and the cleaning roller 43 via the urging spring 140 and the feeding block 151.

—Pressing Spring—

In Exemplary Embodiment 1, a pressing spring 160 is provided between the positioning holder 110 and the charge housing 41. The pressing spring 160 has a pressing plate 161 that extends along the vertical wall 152 of the feeding block 151. An elastic plate 162 is disposed in a bent state on the lateral wall side of the charge housing 41 with respect to the pressing plate 161. Elastically deforming the elastic plate 162 toward the pressing plate 161 causes the elastic plate 162 to press the feeding block 151 and the positioning holder 110 integrally in the axial direction toward the charging roller 42 and the cleaning roller 43.

The pressing plate 161 of the pressing spring 160 is provided with a positioning hole 165 into which the positioning pin 118 of the positioning holder 110 is fitted. The distal end of the elastic plate 162 is provided with a catching strip 166 formed by a bent strip. The catching strip 166 is caught in a recess 415 that is formed in the charge housing 41 in advance. Consequently, the pressing spring 160 is disposed in a predetermined position to press the positioning holder 110 together with the feeding block 151.

—Attaching Procedure for Bearing Mechanism on Feeding Side—

Next, an attaching procedure for the bearing mechanism on the feeding side will be described.

Figure 12A:
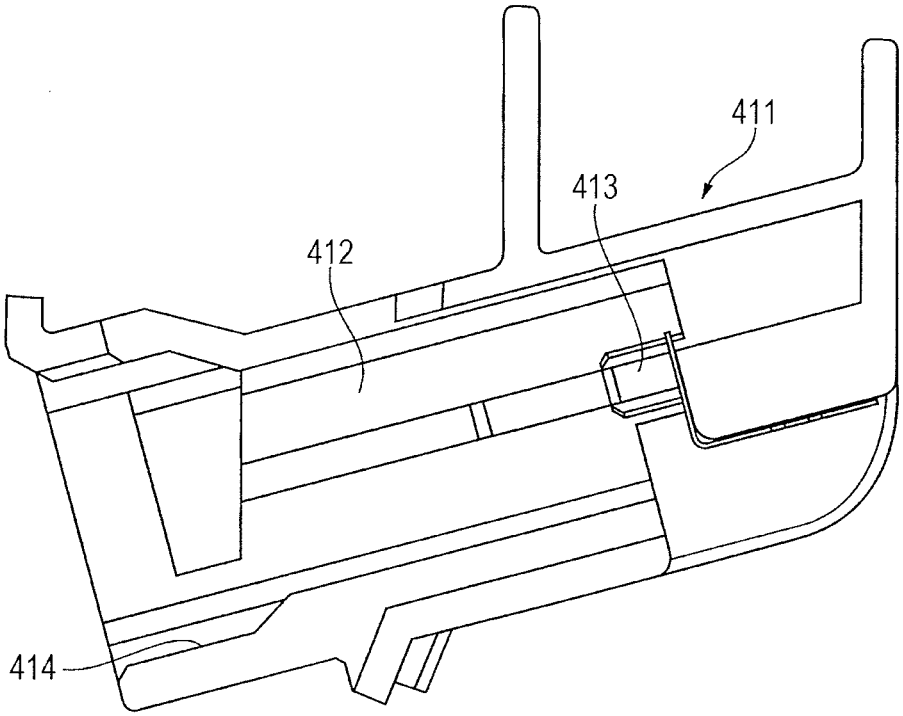
FIG. 12A illustrates a state of a charge housing prior to incorporation of a bearing structure into the charge housing according to Exemplary Embodiment 1.
Figure 12B:
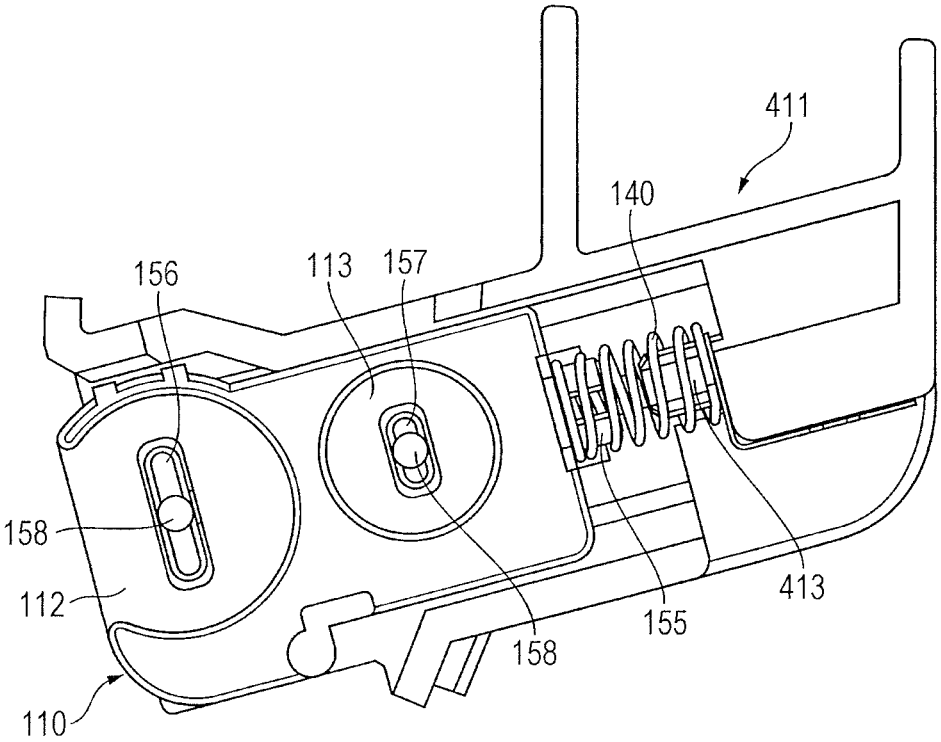
FIG. 12B illustrates a state in which a holder for the bearing structure is incorporated into the charge housing illustrated in FIG. 12A, together with a feeding mechanism.

Now, as illustrated in FIG. 12A, with respect to the mounting part 411 of the charge housing 41, the urging spring 140 is temporarily mounted to the positioning boss 413 of the mounting part 411 to attach the positioning holder 110 and the feeding mechanism 150 in advance as illustrated in FIG. 12B. Then, in this state, the positioning holder 110 and the feeding mechanism 150 are integrally pushed in toward the positioning boss 413 from the photoconductor 31 side along the guide rail 414 of the mounting part 411.

Once the positioning holder 110 is pushed in to a predetermined position, the catching boss 155 of the feeding mechanism 150 comes into contact with the urging spring 140 and is then caught on the urging spring 140.

At this time, in the present example, the catching strip 166 of the pressing spring 160 is caught in the recess 415 of the mounting part 411, causing the positioning holder 110 and the feeding mechanism 150 to be incorporated into a predetermined position.

Figure 13A:
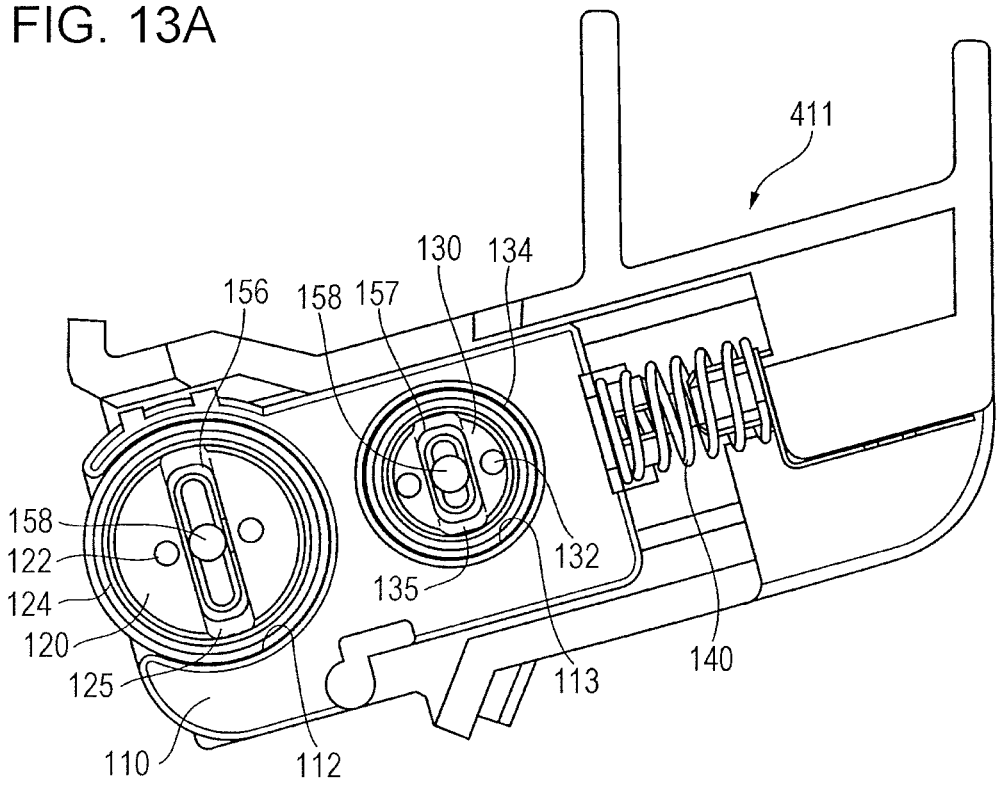
FIG. 13A illustrates a state in which bearing members are incorporated into the holder illustrated in FIG. 12B.

Thereafter, as illustrated in FIG. 13A, the bearing members 120 and 130 are fitted into the recesses 112 and 113 of the positioning holder 110, respectively. When fitting the bearing members 120 and 130 at this time, it is necessary to align the elongated holes 125 and 135 with the feeding projections 156 and 157 serving as detent members so that the elongated holes 125 and 135 fit onto the feeding projections 156 and 157, respectively.

Figure 13B:
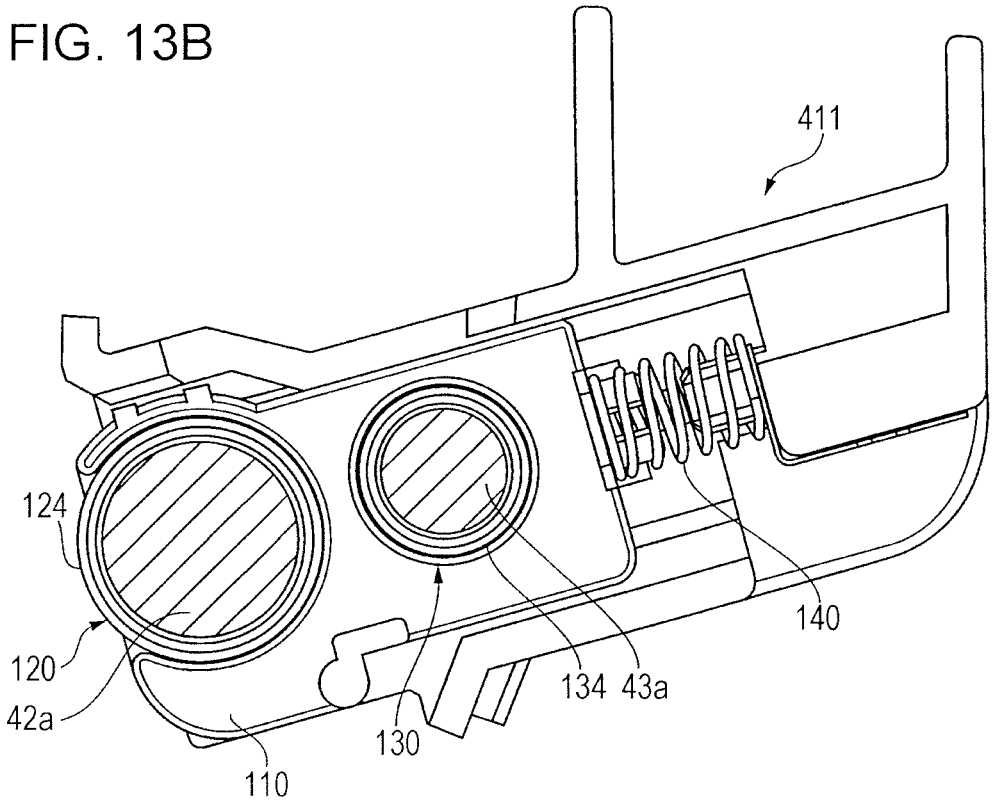
FIG. 13B illustrates a state in which a charging roller and a cleaning roller are incorporated into the bearing structure on the feeding side illustrated in FIG. 13A.
Figure 14:
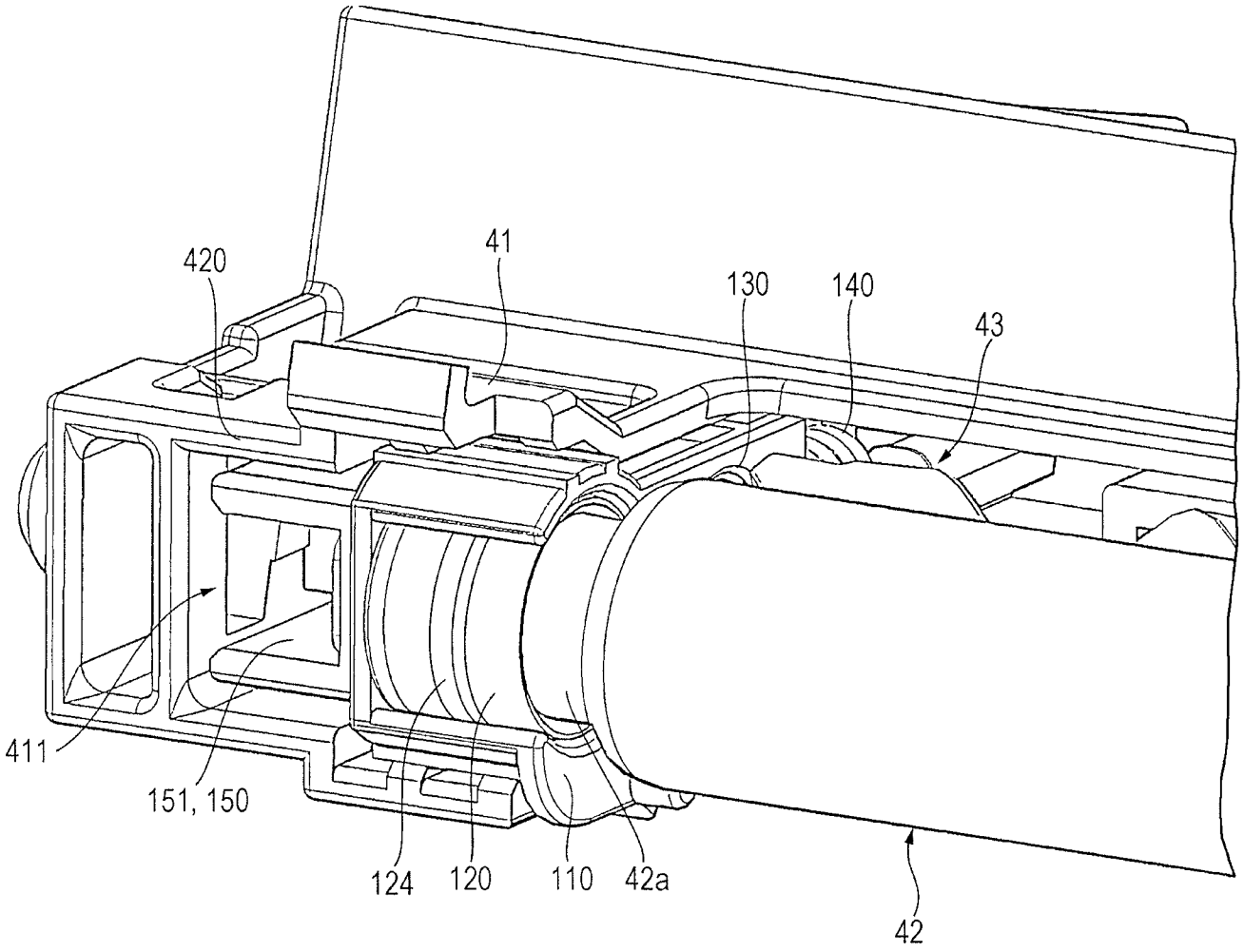
FIG. 14 illustrates a structure of a charge housing around a bearing structure on the feeding side according to Exemplary Embodiment 1.

In this state, as illustrated in FIG. 13B, the shaft 42*a* of the charging roller 42 and the shaft 43*a* of the cleaning roller 43 are fitted into the recesses 121 and 131 of the bearing members 120 and 130 incorporated in the positioning holder 110, respectively.

—Operation of Bearing Mechanism on Feeding Side—

(1) Rotation of Charging Roller and Cleaning Roller

In the bearing mechanism 100 on the feeding side, the positioning holder 110 is urged toward the photoconductor 31 with a predetermined urging force by the urging spring 140. Consequently, the charging roller 42 is urged toward the photoconductor 31 under constant load.

As the photoconductor 31 is rotationally driven in this state, this rotation causes the charging roller 42 in contact with the photoconductor 31 to rotate, which further causes the cleaning roller 43 in contact with the charging roller 42 to rotate.

At this time, in the bearing mechanism 100 on the feeding side, the bearing members 120 and 130 are incorporated in the recesses 112 and 113 of the positioning holder 110 with their rotation being arrested. In the present example, the feeding projections 156 and 157 of the feeding mechanism 150 are engaged with the elongated holes 115 and 116 of the positioning holder 110 and the elongated holes 125 and 135 of the bearing members 120 and 130, thereby arresting rotation of the bearing members 120 and 130, respectively.

Consequently, with the rotation of the bearing members 120 and 130 being arrested, the bearing members 120 and 130 support the shafts 42*a* and 43*a* of the charging roller 42 and the cleaning roller 43, respectively, in a manner that allows their rotation. For the bearing members 120 and 130, a POM with a low coefficient of friction and a high wear resistance is used. Therefore, in this state, there is very little frictional resistance between the inner peripheral surface of the recess 121 or 131 of the bearing member 120 or 130 and the shaft 42*a* or 43*a* of the charging roller 42 or the cleaning roller 43. This allows the charging roller 42 and the cleaning roller 43 to rotate in a stable manner.

(2) Maintaining of Axis-to-Axis Distance by Positioning Holder

As illustrated in FIG. 5, in the positioning holder 110, the bearing members 120 and 130 are incorporated into the recesses 112 and 113, and the shafts 42*a* and 43*a* of the charging roller 42 and the cleaning roller 43 are supported by the bearing members 120 and 130, respectively.

At this time, in the positioning holder 110, the center-to-center distance between the recesses 112 and 113 is constant. Therefore, the axis-to-axis distance between the charging roller 42 and the cleaning roller 43 is basically kept constant.

The positioning holder 110, which is urged toward the photoconductor 31 by the urging spring 140, sometimes moves against the urging force of the urging spring 140 when, for example, the charging roller 42 or the cleaning roller 43 undergoes flexural deformation. However, in the positioning holder 110, the holder body 111 moves integrally while keeping the center-to-center distance between the recesses 112 and 113 constant. Therefore, the charging roller 42 and the cleaning roller 43 move by a constant displacement. Consequently, the axis-to-axis distance between the charging roller 42 and the cleaning roller 43 does not change.

(3) Behavior of Bearing Members During Flexural Deformation of Charging Roller and Cleaning Roller In the present example, the charging roller 42 and the cleaning roller 43 undergo flexural deformation due to their own weights. In particular, if the charging roller 42 and the cleaning roller 43 have different outside diameters or are made of different materials, it is highly likely that the amount of flexural deformation also differs between the two rollers.

When the charging roller 42 or the cleaning roller 43 undergoes flexural deformation in such a state, this causes a change in the orientation of the shaft 42*a* of the charging roller 42 or the shaft 43*a* of the cleaning roller 43 which is held by the bearing member 120 or 130.

Figure 11A:
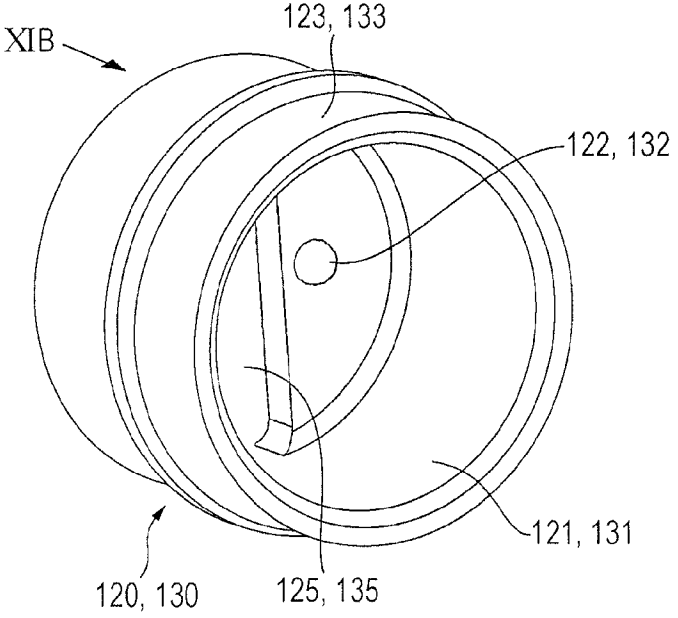
FIG. 11A is a perspective view illustrating a bearing member according to Exemplary Embodiment 1.
Figure 11B:
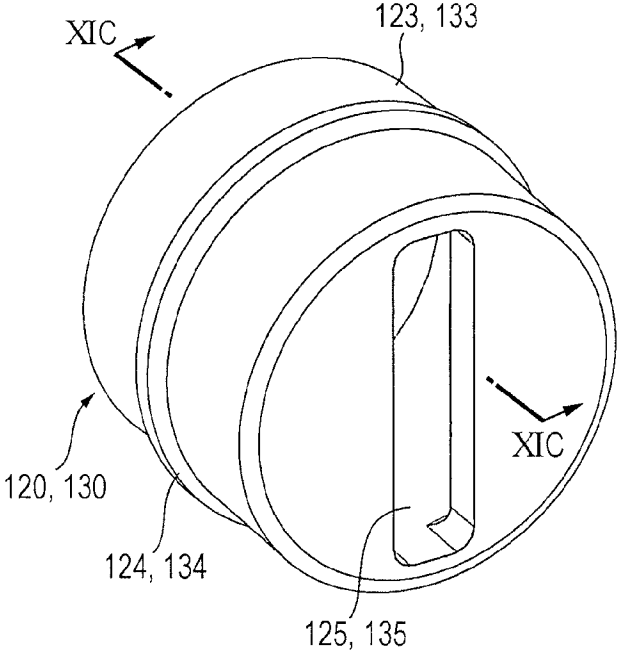
FIG. 11B is a view as seen from a direction XIB in FIG. 11A.
Figure 11C:
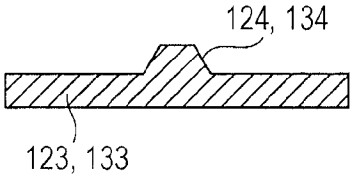
FIG. 11C is a cross-sectional view taken along a line XIC-XIC in FIG. 11B.
Figure 11D:
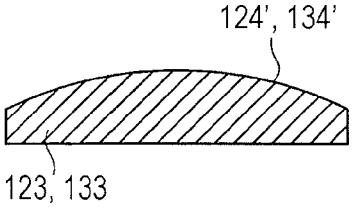
FIG. 11D illustrates a modification of FIG. 11C.

At this time, the bearing member 120 or 130 is incorporated in the recess 112 or 113 of the positioning holder 110 in a state in which, as illustrated in FIGS. 11A and 11B, the flange 124 or 134 is in contact with the inner peripheral surface of the recess 112 or 113 of the positioning holder 110.

Consequently, when the shaft 42*a* or 43*a* of the charging roller 42 or the cleaning roller 43 changes its orientation, the bearing member 120 or 130 is able to change its orientation about the contact part between the flange 124 or 134 and the recess 112 or 113 of the positioning holder 110 as an axis.

(4) Feeding Operation by Feeding Mechanism

In the present example, as illustrated in FIG. 5, power fed from the connection terminal 170 used for power feeding is transmitted to the feeding block 151 via the urging spring 140, and then fed to the axial end portion of the charging roller 42 and the axial end portion of the cleaning roller 43 via the feeding projections 156 and 157, respectively.

As a result, a charging bias and a cleaning bias are applied to the charging roller 42 and the cleaning roller 43, respectively.

In the present example, the charging roller 42 or the cleaning roller 43 receives feeding of power from its axial end portion, thus making it unnecessary to feed power to the charging roller 42 or the cleaning roller 43 via the bearing member 120 or 130.

Further, in the present example, the pressing spring 160 presses the feeding block 151 and the positioning holder 110 toward the charging roller 42 and the cleaning roller 43. Accordingly, the state of contact between the feeding projection 156 or 157 and the charging roller 42 or the cleaning roller 43 may be made stable.

Furthermore, in the present example, the minute projection 158 is provided in a part of each of the feeding projections 156 and 157. The minute projection 158 serves as a contact part with the axial end portion of the charging roller 42 or the axial end portion of the cleaning roller 43. This ensures good contact between the minute projection 158 and the axial end portion of the charging roller 42 or the cleaning roller 43, even if the charging roller 42 or the cleaning roller 43 undergoes flexural deformation and the shaft 42*a* or 43*a* changes in orientation.

<Structure of Charge Housing in Vicinity of Bearing Mechanism on Feeding Side>

(1) In the present example, the charge housing 41 has, in the vicinity of the bearing mechanism 100 on the feeding side, a stopping wall 420 located on the back side of the positioning holder 110 opposite to the side where the bearing members 120 and 130 are held. The stopping wall 420 has a substantially U-shaped cross section and opens toward the positioning holder 110. The positioning holder 110 is brought into contact with the stopping wall 420. The stopping wall 420 has such a cross-sectional shape that provides a high flexural rigidity. This means that the stopping wall 420 is unlikely to be damaged even upon application of an axial load from the charging roller 42 or the cleaning roller 43.

(2) In the present example, the feeding block 151 of the feeding mechanism 150 may be disposed farther away from the photoconductor 31 than a part of the positioning holder 110 located on the photoconductor 31 side. Accordingly, there is little fear of leakage between the photoconductor 31 and the feeding block 151.

—Bearing Mechanism on Non-Feeding Side—

Figure 15:
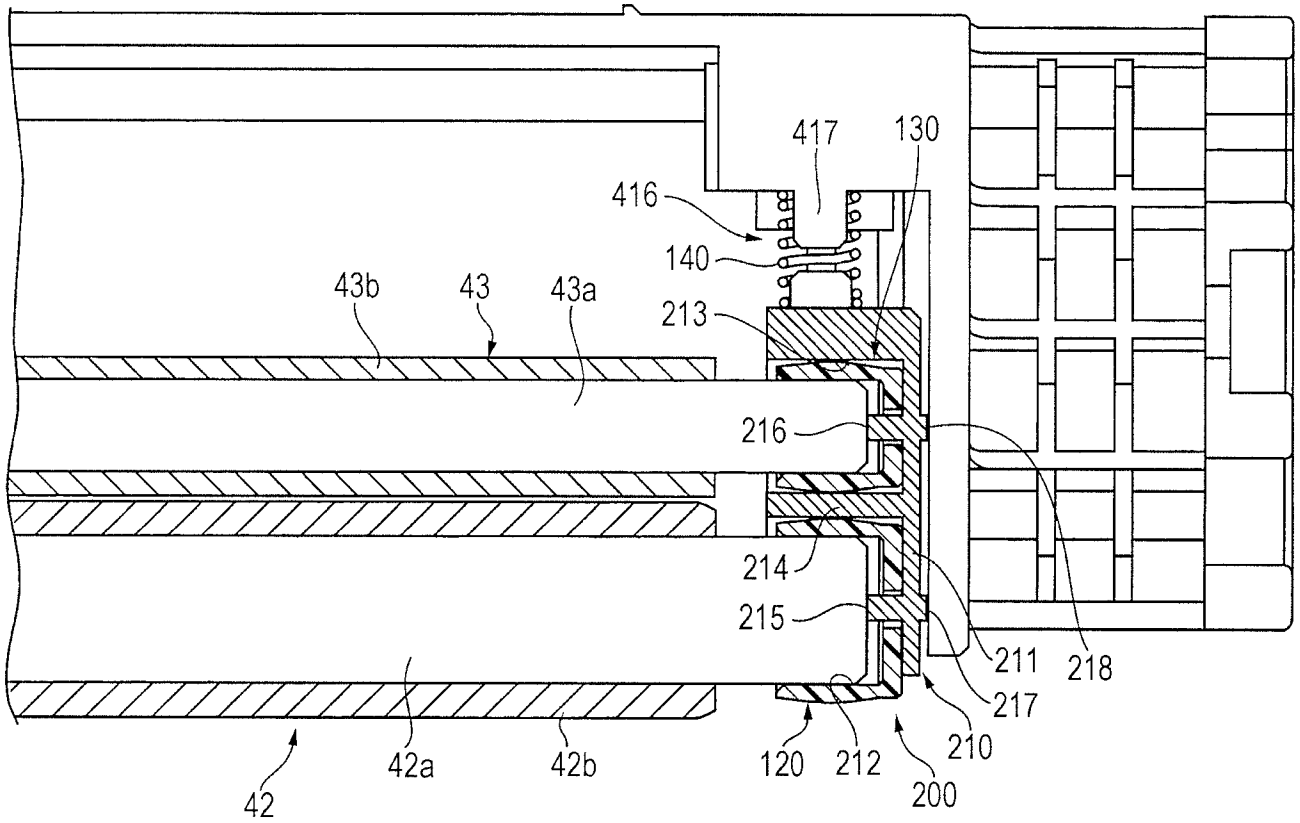
FIG. 15 illustrates a bearing structure on the non-feeding side of a charging device according to Exemplary Embodiment 1.

The bearing mechanism 200 on the non-feeding side has a structure as illustrated in FIG. 15, for example.

In FIG. 15, for the bearing mechanism 200, a mounting part 416 for incorporating the bearing mechanism 200 is provided in a predetermined part of the charge housing 41. A positioning holder 210 is placed in the mounting part 416. The positioning holder 210 holds the respective shafts 42*a* and 43*a* of the charging roller 42 and the cleaning roller 43 so as to keep the distance between the axes of the charging roller 42 and the cleaning roller 43 constant. The bearing members 120 and 130, which support the shafts 42*a* and 43*a* in a manner that allows their rotation, are incorporated into the positioning holder 210. Further, the urging spring 140 formed by, for example, a coil spring is provided to urge the positioning holder 210 toward the photoconductor 31.

In the present example, the basic structure of the positioning holder 210 is substantially the same as the positioning holder 110 on the feeding side. That is, the positioning holder 210 has a holder body 211 made of, for example, commonly used resin (for example, POM). The holder body 211 is provided with recesses 212 and 213 into which the bearing members 120 and 130 are fitted, respectively, with a partition wall 214 therebetween.

In the present example, detent members 215 and 216 as detent mechanisms for the bearing members 120 and 130 are formed integrally with the inner surfaces of the bottom walls of the recesses 212 and 213 of the positioning holder 210, respectively.

Spacer members 217 and 218 are provided on the back side of the holder body 211 of the positioning holder 210 opposite to the recesses 212 and 213. The spacer members 217 and 218 are used to fill the gap between the positioning holder 210 and the mounting part 416.

In the present example, the bearing members 120 and 130, and the urging spring 140 are substantially the same as those used in the bearing mechanism 100 on the feeding side.

In substantially the same manner as the mounting part 411, the mounting part 416 of the charge housing 41 is provided with a positioning boss 417 for the urging spring 140, and also a guide rail (not illustrated).

Next, an attaching procedure for the bearing mechanism 200 on the non-feeding side will be described.

Now, as illustrated in FIG. 15, with respect to the mounting part 416 of the charge housing 41, the urging spring 140 is temporarily mounted to the positioning boss 417 of the mounting part 416, thus attaching the positioning holder 210 in advance. Then, the positioning holder 210 is pushed in toward the positioning boss 417 from the photoconductor 31 side along the guide rail (not illustrated) of the mounting part 416.

Once the positioning holder 210 is pushed in to a predetermined position, the positioning holder 210 comes into contact with the urging spring 140 and is then urged toward the photoconductor 31 under constant load.

Thereafter, the bearing members 120 and 130 are fitted into the recesses 212 and 213 of the positioning holder 210, respectively. When fitting the bearing members 120 and 130 at this time, it is necessary to ensure alignment so that the elongated holes 125 and 135 fit onto the detent members 215 and 216, respectively.

In this state, the shaft 42*a* of the charging roller 42 and the shaft 43*a* of the cleaning roller 43 are fitted into the recesses 121 and 131 of the bearing members 120 and 130 incorporated in the positioning holder 210, respectively.

The bearing mechanism 200 on the non-feeding side is substantially the same as the bearing mechanism 100 on the feeding side, except for the operation of the feeding mechanism 150.

Figure 16:
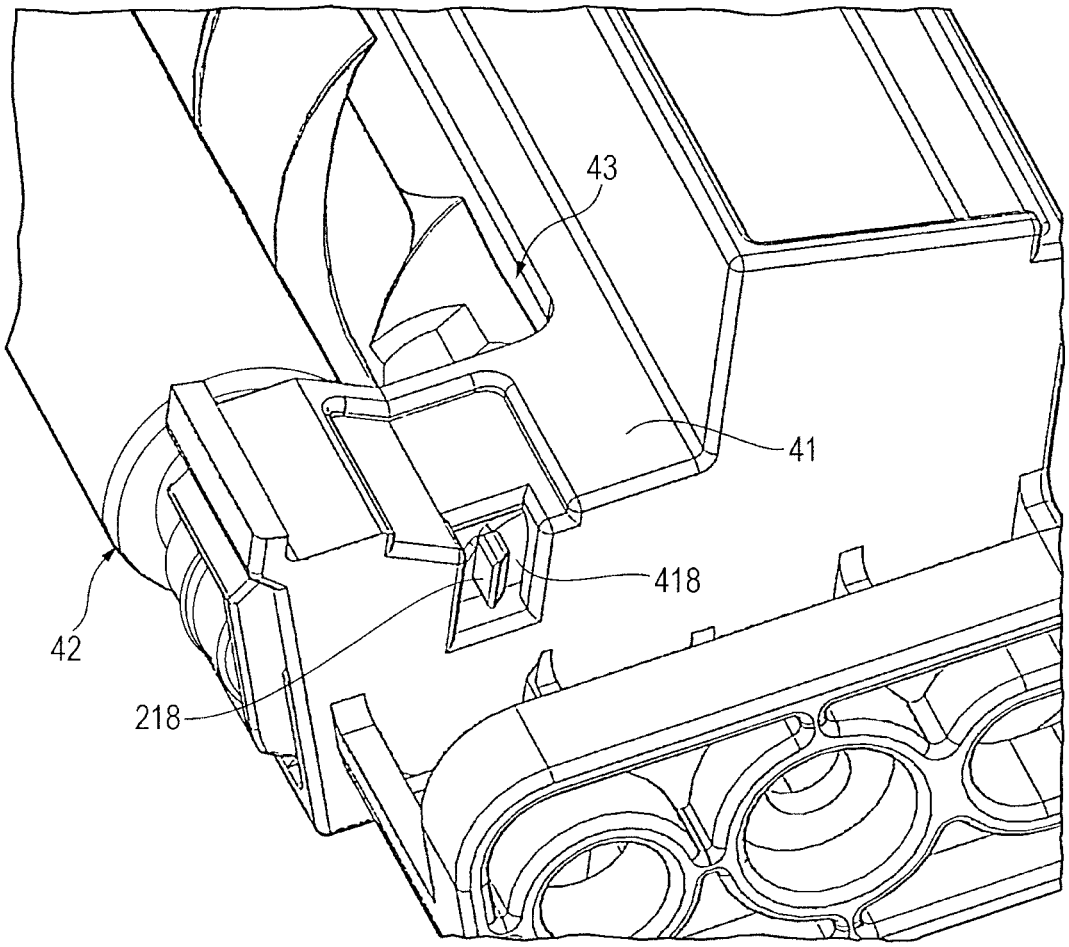
FIG. 16 illustrates a portion XVI in FIG. 3 in detail.

Further, in Exemplary Embodiment 1, as illustrated in FIG. 16, a catching hole 418 is provided in a part of the mounting part 416 of the charge housing 41 and, for example, the spacer member 218 is caught in the catching hole 418. In this way, the spacer member 218 also serves as a detachment preventing member.

A charging device according to Comparative Example 1 below will be described hereinafter to evaluate the performance of the charging device according to Exemplary Embodiment 1.

Comparative Example 1

Figure 17:
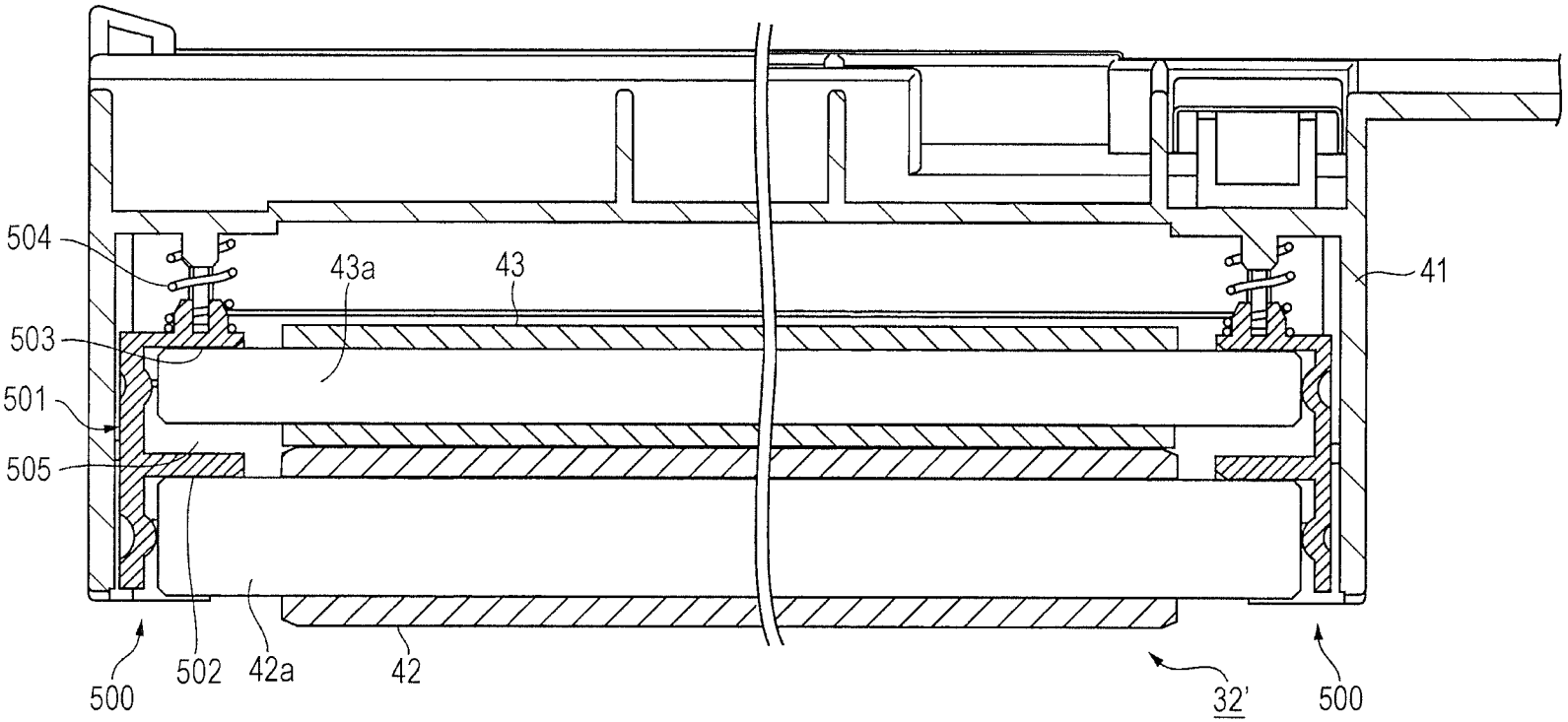
FIG. 17 illustrates a major portion of a bearing structure of a charging device according to Comparative Example 1.

FIG. 17 illustrates a major portion of a bearing structure of a charging device according to Comparative Example 1.

In FIG. 17, a charging device 32' has the charging roller 42 that contacts a photoconductor (not illustrated), the cleaning roller 43 that contacts the charging roller 42, a bearing mechanism 500 that supports the axial end portions of the respective shafts 42*a* and 43*a* of the charging roller 42 and the cleaning roller 43, and the charge housing 41 that accommodates these components.

In the present example, the basic structure of the bearing mechanism 500 is substantially the same between the feeding side and the non-feeding side. A bearing block 501 made of resin is provided with bearing parts 502 and 503 into which the shafts 42*a* and 43*a* are fitted, respectively. The shafts 42*a* and 43*a* are rotatably supported by the bearing parts 502 and 503, respectively, and the bearing block 501 is urged toward the photoconductor by an urging spring 504 to bring the charging roller 42 into contact with the photoconductor.

In particular, in Comparative Example 1, a backlash 505 as play is set in advance between the bearing part 502 or 503 and the shaft 42*a* or 43*a*, thus absorbing a change in the orientation of the shaft 42*a* or 43*a* due to flexural deformation of the charging roller 42 or the cleaning roller 43.

Further, in the bearing mechanism 500 on the feeding side, at least the bearing block 501 is made of a conductive resin material. Consequently, power is fed along a feeding path that runs from the urging spring 504 side and passes through the bearing part 502 or 503 of the bearing block 501 to reach the contact part between the bearing part 502 or 503 and the shaft 42*a* or 43*a* of the charging roller 42 or the cleaning roller 43.

Comparative Example 1 has the following effect.

The charging roller 42 and the cleaning roller 43 are rotatably supported by the bearing parts 502 and 503 of the bearing block 501, respectively.

In the present example, the backlash 505 as play is provided in each of the bearing parts 502 and 503. Accordingly, even if the shaft 42*a* or 43*a* changes in orientation upon flexural deformation of the charging roller 42 or the cleaning roller 43, the change in orientation may be absorbed.

However, the presence of the backlash 505 as play mentioned above may cause the axis-to-axis distance between the charging roller 42 and the cleaning roller 43 to vary.

In this regard, the backlash 505 as play may be minimized to reduce such variation of the axis-to-axis distance. However, this also reduces the margin for absorbing changes in orientation caused by flexural deformation of the charging roller 42 and the cleaning roller 43, which can result in noise or impair responsive rotation of these rollers.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging device comprising:

a charging member that is opposed to and contacts a charged body that is to be electrically charged, the charging member extending in an axial direction, the charging member rotating in response to rotation of the charged body, the charging member having a shaft;

a cleaning member that extends in an axial direction along the charging member, the cleaning member contacting a surface of the charging member to clean the charging member, the cleaning member having a shaft;

a holding member that has a plurality of recesses which support respectively the charging member and the cleaning member in a manner that allows the charging member and the cleaning member to be displaced by a substantially constant amount while maintaining a distance between their axes;

a plurality of bearing members respectively fitted into the plurality of recesses of the holding member in a state in which rotation of the bearing members is arrested, wherein a first of the plurality of bearing members individually supporting only one shaft from among the shaft of the charging member and the shaft of the cleaning member and a second of the plurality of bearing members individually supporting the other shaft among the shaft of the charging member and the shaft of the cleaning member in a manner that allows rotation of the shafts, the bearing members being displaced so as to follow a change in orientation of the shafts; and an urging member that urges the holding member so as to press the charging member onto the charged body, wherein:

each of the bearing members has a receiving part that supports the shaft of the charging member or the shaft of the cleaning member in a manner that allows rotation of the shaft, the receiving part being formed by a recess having a substantially circular cross-section;

the charging device further comprises a detent member disposed in the holding member; and the receiving part has a mating detent part at a bottom of the receiving part, the mating detent part being engaged with the detent member disposed in the holding member to arrest rotation.

2. The charging device according to claim 1, wherein:

each of the bearing members has a receiving part that supports the shaft of the charging member or the shaft of the cleaning member in a manner that allows rotation of the shaft, the receiving part being formed by a recess having a substantially circular cross-section;

the receiving part has an overhanging part that hangs over outward, the overhanging part being formed annularly in a part of an outer peripheral wall of the receiving part; and each of the bearing members changes its orientation about a contact part between the overhanging part and the holding member as an axis.

3. The charging device according to claim 1, wherein each of the bearing members comprises a polyacetal that is electrically non-conductive.

4. The charging device according to claim 1, wherein:

the holding member has a recess into which each of the bearing members fits, and a detent member that is disposed at a bottom of the recess;

each of the bearing members has a mating detent part that is formed in advance; and the mating detent part and the detent member are engaged with each other upon fitting each of the bearing members into the recess.

5. The charging device according to claim 1, further comprising:

a charge housing that accommodates the charging member, the cleaning member, the holding member, the bearing members, and the urging member; and an axially pressing member that presses the charging member and the cleaning member in an axial direction, the axially pressing member being provided between the charge housing and the holding member.

6. The charging device according to claim 1, further comprising:

a charge housing that accommodates the charging member, the cleaning member, the holding member, the bearing members, and the urging member, wherein the charge housing has a stopping wall provided on a back side of the holding member opposite to a side of the holding member which holds the bearing members, the stopping wall opening toward the holding member and having a substantially U-shaped cross-section, and wherein the holding member is brought into contact with the stopping wall.

7. An image forming apparatus comprising:

an image carrier that is capable of carrying an electrostatic latent image, the image carrier being a charged body that is to be electrically charged; and the charging device according to claim 1 that charges the image carrier.

8. A charging device comprising:

a charging member that is opposed to and contacts a charged body that is to be electrically charged, the charging member extending in an axial direction, the charging member rotating in response to rotation of the charged body, the charging member having a shaft;

a cleaning member that extends in an axial direction along the charging member, the cleaning member contacting a surface of the charging member to clean the charging member, the cleaning member having a shaft;

a holding member that has a plurality of recesses which support respectively the charging member and the cleaning member in a manner that allows the charging member and the cleaning member to be displaced by a substantially constant amount while maintaining a distance between their axes;

a plurality of bearing members respectively fitted into the plurality of recesses of the holding member in a state in which rotation of the bearing members is arrested, wherein a first of the plurality of bearing members individually supporting only one shaft from among the shaft of the charging member and the shaft of the cleaning member and a second of the plurality of bearing members individually supporting the other shaft among the shaft of the charging member and the shaft of the cleaning member in a manner that allows rotation of the shafts, the bearing members being displaced so as to follow a change in orientation of the shafts; and an urging member that urges the holding member so as to press the charging member onto the charged body, wherein:

at least one of the charging member and the cleaning member is a fed member that is to be fed with electric power; and the charging device further comprises a feeding member provided on one axial end side of the fed member, the feeding member being in contact with an axial end portion of the fed member, and wherein:

each of the bearing members has a receiving part that supports the shaft of the charging member or the shaft of the cleaning member in a manner that allows rotation of the shaft, the receiving part being formed by a recess having a substantially circular cross-section;

the charging device further comprises a detent member disposed in the holding member; and the receiving part has a mating detent part at a bottom of the receiving part, the mating detent part being engaged with the detent member disposed in the holding member to arrest rotation.

9. The charging device according to claim 8, wherein:

the feeding member has a feeding conductive member disposed on a back side of the holding member opposite to a side of the holding member which holds the bearing members;

the holding member and the bearing members each have a through-hole; and the feeding conductive member has a feeding projection, the feeding projection projecting through the through-hole formed in each of the holding member and the bearing members to come into contact with an end face of the fed member.

10. The charging device according to claim 8, wherein the feeding member doubles as a detent member, the detent member being disposed in the holding member and capable of arresting rotation of each of the bearing members.

11. The charging device according to claim 8, wherein the feeding member has a projecting part provided in a part of the feeding member so as to contact the axial end portion of the fed member, the projecting part permitting a change in orientation of the axial end portion of the fed member.

12. The charging device according to claim 8, wherein:

each of the bearing members comprises a non-conductive bearing member that is electrically non-conductive; and a part of the feeding member located closest to the charged body is disposed farther away from the charged body than the non-conductive bearing member that supports the charging member.

13. A charging device comprising:

a charging member that is opposed to and contacts a charged body that is to be electrically charged, the charging member extending in an axial direction, the charging member rotating in response to rotation of the charged body, the charging member having a shaft;

a cleaning member that extends in an axial direction along the charging member, the cleaning member contacting a surface of the charging member to clean the charging member, the cleaning member having a shaft;

a holding member that has a plurality of recesses which support respectively the charging member and the cleaning member in a manner that allows the charging member and the cleaning member to be displaced by a substantially constant amount while maintaining a distance between their axes;

a plurality of bearing members respectively fitted into the plurality of recesses of the holding member in a state in which rotation of the bearing members is arrested, wherein a first of the plurality of bearing members individually supporting only one shaft from among the shaft of the charging member and the shaft of the cleaning member and a second of the plurality of bearing members individually supporting the other shaft among the shaft of the charging member and the shaft of the cleaning member in a manner that allows rotation of the shafts, the bearing members being displaced so as to follow a change in orientation of the shafts; and an urging member that urges the holding member so as to press the charging member onto the charged body, wherein:

each of the bearing members has a receiving part that supports the shaft of the charging member or the shaft of the cleaning member in a manner that allows rotation of the shaft, the receiving part being formed by a recess having a substantially circular cross-section;

the receiving part has an overhanging part that hangs over outward, the overhanging part being formed annularly in a part of an outer peripheral wall of the receiving part; and each of the bearing members changes its orientation about a contact part between the overhanging part and the holding member as an axis.

14. The charging device according to claim 13, wherein:

the holding member has a recess into which each of the bearing members fits, and a detent member that is disposed at a bottom of the recess;

each of the bearing members has a mating detent part that is formed in advance; and the mating detent part and the detent member are engaged with each other upon fitting each of the bearing members into the recess.

15. The charging device according to claim 13, further comprising:

a charge housing that accommodates the charging member, the cleaning member, the holding member, the bearing members, and the urging member; and an axially pressing member that presses the charging member and the cleaning member in an axial direction, the axially pressing member being provided between the charge housing and the holding member.

16. The charging device according to claim 13, further comprising:

a charge housing that accommodates the charging member, the cleaning member, the holding member, the bearing members, and the urging member, wherein the charge housing has a stopping wall provided on a back side of the holding member opposite to a side of the holding member which holds the bearing members, the stopping wall opening toward the holding member and having a substantially U-shaped cross-section, and wherein the holding member is brought into contact with the stopping wall.

17. An image forming apparatus comprising:

an image carrier that is capable of carrying an electrostatic latent image, the image carrier being a charged body that is to be electrically charged; and the charging device according to claim 13 that charges the image carrier.

* * * * *